US008776289B2

(12) United States Patent
Ko et al.

(10) Patent No.: US 8,776,289 B2
(45) Date of Patent: Jul. 15, 2014

(54) SENIOR FRIENDLY SHOWER CARRIER

(75) Inventors: Cheol Woong Ko, Cheonan (KR); Kyeoung Jin Chun, Uiwang (KR); Soo Taek Kim, Seongnam (KR); Deok Yeon Cho, Goyang (KR); Yeong Chan Kwak, Bucheon (KR)

(73) Assignee: Korea Institute of Industrial Technology, Cheonan (KR)

( * ) Notice: Subject to any disclaimer, the term of this patent is extended or adjusted under 35 U.S.C. 154(b) by 207 days.

(21) Appl. No.: 13/581,310

(22) PCT Filed: Nov. 30, 2011

(86) PCT No.: PCT/KR2011/009227

§ 371 (c)(1),
(2), (4) Date: Aug. 25, 2012

(87) PCT Pub. No.: WO2012/074297

PCT Pub. Date: Jun. 7, 2012

(65) Prior Publication Data

US 2012/0317725 A1 Dec. 20, 2012

(30) Foreign Application Priority Data

| | | |
|---|---|---|
| Nov. 30, 2010 | (KR) | 10-2010-0120321 |
| Aug. 3, 2011 | (KR) | 10-2011-0077388 |
| Sep. 28, 2011 | (KR) | 10-2011-0098005 |
| Nov. 14, 2011 | (KR) | 10-2011-0118317 |

(51) Int. Cl.
*A61G 7/012* (2006.01)

(52) U.S. Cl.
USPC ..... 5/611; 5/86.1

(58) Field of Classification Search
USPC ..... 5/611, 86.1, 613, 616, 11
See application file for complete search history.

(56) References Cited

U.S. PATENT DOCUMENTS

| | | | | |
|---|---|---|---|---|
| 4,875,555 | A | 10/1989 | Johansson et al. | |
| 5,193,633 | A * | 3/1993 | Ezenwa | 180/65.1 |
| 5,285,539 | A * | 2/1994 | Anderson et al. | 4/564.1 |
| 7,712,389 | B2 * | 5/2010 | Wang | 74/89.23 |
| 2002/0162410 | A1 * | 11/2002 | Zimmerman | 74/89.35 |

FOREIGN PATENT DOCUMENTS

| | | | |
|---|---|---|---|
| JP | 050048750 | A | 6/1993 |
| JP | 1997164170 | A | 6/1997 |
| JP | 2001293044 | A | 10/2001 |
| JP | 2004194844 | A | 7/2004 |
| KR | 1019980050838 | A | 9/1998 |
| KR | 100228089 | B1 | 11/1999 |

(Continued)

*Primary Examiner* — Fredrick Conley
(74) *Attorney, Agent, or Firm* — Patent Office of Dr. Chung Park

(57) ABSTRACT

There is disclosed a senior-friendly shower carrier comprising a bed; a housing part comprising a second housing, a first housing coupled to a lower portion of the bed to elevate to an upper portion of the second housing and a third housing that elevates to a lower portion of the second housing; a first elevating module comprising a driving motor having a shaft provided therein, a fixing part, a power transmitting part which transmits a rotational force of the shaft to the fixing part, and a moving part which elevates the first housing upwardly, moving along the rotation of the fixing part upwardly and downwardly; and a second elevating module comprising a driving motor having a shaft provided therein, a fixing part, a power transmitting part which transmits a rotational force of the shaft to the fixing part, and a moving part which elevates the third housing downwardly.

37 Claims, 21 Drawing Sheets

(56) References Cited

FOREIGN PATENT DOCUMENTS

| | | | |
|---|---|---|---|
| KR | 100229441 | B1 | 11/1999 |
| KR | 1020010076856 | A | 8/2001 |
| KR | 200333285 | Y1 | 11/2003 |
| KR | 10-1067983 | B1 | 9/2011 |

* cited by examiner

SENIOR FRIENDLY SHOWER CARRIER

CROSS-REFERENCE TO PRIOR APPLICATIONS

This application is a national Stage Patent Application of PCT International Patent Application No. PCT/KR2011/009227, filed on Nov. 30, 2011 under 35 U.S.C. §371, which claims priority of Korean Patent Application Nos. 10-2010-0120321, filed on Nov. 30, 2010, 10-2011-0077388, filed on Aug. 3, 2011, 10-2011-0098005, filed on Sep. 28, 2011, and 10-2011-0118317, filed on Nov. 14, 2011, which are all hereby incorporated by reference in their entirety.

TECHNICAL FIELD

The present invention relates to a senior-friendly shower carrier, more particularly, to a senior-friendly shower carrier which is able to enhance space utilization by arranging a plurality of elevating modules effectively and to increase up-and-down displacement.

BACKGROUND

Generally, people who are unable to take a bath or shower for themselves such as the senior, serious patients and the handicapped require the carers' assistance to take a bath or shower. With the recent increase of the older population, patients unable to wash themselves have been increased and the carer services are overloaded. Various devices have been introduced to enhance patient convenience or carer convenience.

Out of the various devices, a shower carrier is the equipment that enables a patient to be moved or washed in a state of lying thereon.

A conventional shower carrier includes a bed for a carer to elevate a patient when a patient is moved to take a shower.

Referring to FIG. 1, the elevation of the bed may be realized in various methods. Typically, for the elevation of the bed, there are provided with an elevating module 40 driven to expand the length in an up and down direction, a fixing housing 30 having the elevating module 40 fixed thereto, and a moving housing 50 movable in an up and down direction according to the expanded length of the elevating module 40. A bed is provided on the moving housing 50 and the bed is elevated along the elevation of the moving housing 50.

Referring to FIG. 2, the elevating module 40 is longitudinally formed and it includes a fixing part 43 having a screw thread formed in a circumference thereof and a moving part 44 engaging with the screw thread to elevate along the rotation of the fixing part.

A motor 41 may be provided under the fixing part 43 and such a motor 41 may rotate the fixing part 43 directly. However, a motor 41 used in the conventional shower carrier to elevate the bed a heavy load is applied to may be positioned adjacent to the fixing part 43. The motor 41 includes a power transmission part 42 realized by various gear assemblies such as a decelerator. Such a power transmission part 42 is coupled to a side of the motor 41 to transmit a rotational force of the motor 41 to the fixing part 43.

Accordingly, the weights of the patient and the bed may not be directly to the motor 41 and damage to the motor generated by the load may be prevented. Also, compared with the motor directly connected to the lower end of the fixing part 43, the motor having the power transmission part can be a motor having a smaller capacity used to elevate the bed.

However, the elevating distance of the elevating module 40 provided in the conventional shower carrier is determined based on the length of the fixing part 43. To enlarge the up-and-down displacement, the length of the fixing part 43 has to be increased disadvantageously.

Moreover, when the motor 41 is arranged next to the fixing part 43 to drive the motor effectively, the length of the fixing part 43 has to be larger than the length of the motor 41. Because of that, there might be an empty space formed beyond the motor 41 which cannot be used.

DISCLOSURE

Technical Problem

To solve the problems, an object of the present invention is to provide a shower carrier which is able to enhance space utility inside an entire housing and to increase displacement of up and down movement.

Technical Solution

To achieve these objects and other advantages and in accordance with the purpose of the embodiments, as embodied and broadly described herein, a senior-friendly shower carrier includes a bed on which a patient lies; a housing part comprising a second housing, a first housing coupled to a lower portion of the bed to elevate to an upper portion of the second housing and a third housing to elevate to a lower portion of the second housing; a first elevating module comprising a driving motor having a shaft provided therein, a fixing part rotated on a different shaft from the shaft, a power transmitting part to transmit a rotational force of the shaft to the fixing part, and a moving part to elevate the first housing upwardly, moving along the rotation of the fixing part upwardly and downwardly, the first elevating module positioned in the second housing; and a second elevating module comprising a driving motor having a shaft provided therein, a fixing part rotated on a different shaft from the shaft, a power transmitting part to transmit a rotational force of the shaft to the fixing part, and a moving part to elevate the third housing downwardly, moving along the rotation of the fixing part upwardly and downwardly, the first elevating module positioned in the second housing.

The length of the fixing part provided in each of the first and second elevating modules may be larger than the length of the driving part provided in each of the first and second elevating modules, and each of the driving parts provided in the first and second elevating modules may be provided in a predetermined lower portion of each of the fixing parts, and the driving motors of the first and second elevating modules may be positioned in a space formed between the fixing parts and the moving parts are arranged to elevate in the opposite direction.

A lower surface of the first housing may be open and a space may be formed in the first housing to accommodate the second housing.

An upper surface of the third housing may be open and a space may be formed in the third housing to accommodate the second housing.

A lower surface of the first housing may be open and a space may be formed in the first housing to accommodate the second housing, and an upper surface of the third housing may be open and a space may be formed in the third housing to accommodate the first housing.

An upper surface of the third housing may be open and a space may be formed in the third housing to accommodate the second housing, and an upper surface of the first housing may be open and a space may be formed in the first housing to accommodate the third housing.

The bed may be tilted at a predetermined angle to drain a wash water smoothly.

The senior-friendly shower carrier may further include a headrest to support the head of the patient lying on the bed, with a tilted angle or a projected degree which is variable according to the patient's physical characteristics; and a safety guide part provided in both sides of the bed to stand up selectively, to prevent the patient lying on the bed from falling out of the bed.

The senior-friendly shower carrier may further include a damping member provided between the headrest and the bed to prevent the drastic rotation of the headrest.

A driving unit may be provided to adjust a tilted angle or projected degree of the headrest.

The driving unit may include a hinge part which rotatably couples the headrest to the bed; an actuator which is selectively expanded; an arm coupled to the actuator to be pushed or pulled according to the expansion of the actuator; and a bracket having an end rotatably coupled to a lower portion of the bed and the other end hingedly coupled to the hinge part of the headrest, spaced apart a predetermined distance from the hinge part, the other end formed higher than the end to rotate with respect to the end, with an end of the arm hingedly coupled between the end and the other end and, the bracket which adjusts a tilted angle or projected degree of the headrest while being rotated with respect to the end by the arm.

The safety guide part may include a first safety guide provided in a predetermined portion of the bed, the first safety guide which is able to stand selectively; and a second safety guide provided in the other opposite portion of the bed, the second safety guide which is able to stand selectively, and the first safety guide and the second safety guide may be driven, independent from each other.

The first safety guide and the second safety guide may be made to lie or stand, with rotating.

The first safety guide and the second safety guide may be made selectively to stand beyond the bed or to lie below the bed, with sliding vertically.

The safety guide part may further include a safety guide driving part which drives the first safety guide and the second safety guide to lie or stand independently.

The senior-friendly shower carrier may further include a headrest positioned in an upper portion of the bed, with the patient's head positioned thereon, the headrest having a side hingedly coupled to the bed to rotate with respect to the bed in an upward or downward direction; and a coupling unit comprising a first bed coupling part projected from a predetermined portion of the bed, with a coupling hole formed in a predetermined portion thereof, a head coupling part projected from a side of the headrest, with a first shaft formed therein to be inserted in the coupling hole, a second bed coupling part projected from a side of the bed, with a second shaft partially formed therein, a special bearing coupled to the second shaft to enable the headrest to rotate only in an upward direction, a sprocket coupled to an outer surface of the special bearing, and an angle adjusting handle provided in a side of the headrest, with a side engaging with the sprocket.

The angle adjusting handle may have a side which can be pulled by a user's hand, and when the headrest rotates in the upward direction, the headrest may engage with the sprocket to rotate together with the sprocket. When the headrest rotates in the downward direction, the angle adjusting handle may be pulled upwardly to release the engaging between the sprocket and the angle adjusting handle such that the headrest may be rotatable in the downward direction.

The angle adjusting handle may include an elastic member which provides an elastic force toward the engaging portion with the sprocket.

The senior-friendly shower carrier may further include a headrest comprising a plurality of members rotatable coupled to an end of the bed, the plurality of the members which are able to be tilted by the user's operation independently.

The headrest may include an opening formed in an outer end thereof along a longitudinal direction.

The headrest may include a neck supporting member rotatably coupled to a predetermined portion of the bed to support the patient's neck; and an auxiliary supporting member positioned outer to the neck supporting member in a longitudinal direction, with a side rotatably coupled to the neck supporting member.

The senior-friendly shower carrier may further include a tilting operation part provided in a center portion of the headrest to operate the tiling the headrest.

The tilting operation part may be provided in a coupling area between the neck supporting member and the auxiliary supporting member, to operate the tilting of the neck supporting member and the auxiliary supporting member.

The tilting operation part may include a fixing member provided in a lower surface of an outer end of the neck supporting member in a longitudinal direction; an operation frame movably coupled to a lower surface of the auxiliary supporting member in a horizontal direction; and a moving member provided in a center portion of the operation frame, with being contactable with the fixing member correspondingly.

The tilting operation part may include a moving link provided in a lower surface of the auxiliary supporting member in a longitudinal direction, with an inner end which is able to slide to a lower surface of the neck supporting member; and a control handle provided in an outer end of the auxiliary supporting member, being connected with the moving link to control the sliding.

The tilting operation part may include a gear box provided in the coupling area between the neck supporting member and the auxiliary supporting member, with being rotated by an external force to adjust the tilting of the auxiliary supporting member, and an operation handle connected with the gear box, projected from a lateral surface of the gear box, to provide a rotational force generated by the user.

The senior-friendly shower carrier may further include a base frame coupled to a lower portion of the housing part to support the bed, spaced apart a predetermined distance from the ground, the base frame comprising a plurality of wheels provided in a side thereof to enable the movement of the bed; and a drive-assisting unit comprising a driving wheel in contact with the ground and a driving motor which provides a driving force to the driving wheel, the drive-assisting unit selectively in contact with the ground by the user's operation.

The drive-assisting unit may further include a driving link coupled to at least one of the bed and the base frame, with the driving wheel positioned in a lower end thereof to support the driving wheel, the driving link operated to move the positions of the driving wheel and the motor.

The driving wheel may be positioned between moving wheels to prevent interference with the movement of the shower carrier.

The driving link may be coupled to the driving wheel, to elastically support the driving wheel when the driving wheel contacts with the ground.

The drive-assisting unit may include a lever provided in an end of the bed with a predetermined portion thoroughly fixed to a grip part to surround the grip part, and a wire having both ends connected to the driving link and the lever, respectively, to transmit the external force applied by the user to the driving link.

The driving link may further include an operation handle provided in an outer end thereof to operate the driving of the operation motor by adjusting the rotational movement of the driving link.

The operation motor may measure a rotation number of the moving wheel and adjusts a rotation number of the driving wheel, corresponding to the measured rotation number.

The drive-assisting unit may further include a operation control part which determines whether to operate the driving wheel according to the operation of the driving link.

The operation control part may include a proximity sensor which determines whether to operate the driving wheel by sensing the distance between the driving link and the bed.

The operation control part may include a rotation sensing sensor which determines whether to drive the driving wheel based on a rotational state of the driving link.

Advantageous Effects

The shower carrier according to the embodiments has following advantageous effects.

The shower carrier uses the pair of the elevating modules having the fixing part formed longitudinally and the driving motor formed shorter than the fixing part, provided in the lateral surface of the fixing part to transmit the power to the fixing part. The limited inner space of the housing is utilized effectively and the size of the housing where two elevating modules are installed may be compact.

Furthermore, two elevating modules are arranged in the limited space and the expanded length of each elevating module is in the opposite direction. Accordingly, while maintaining the size of the housing similarly in comparison to the size of the conventional housing, the upward and downward displacement of the shower carrier can be enhanced advantageously.

Still further the tilted angle and the projected degree of the headrest may be adjusted according to the patient's physical body shape. The patient's comfort can be enhanced. When the carer washes the patient's hair, the carer need not support the patient head by the hand and the head may be elevated by adjusting the angle and the projected degree of the headrest. Accordingly, the carer's convenience may be enhanced advantageously.

Still further, the safety guide part is able to stand or lie independently. When trying to wash the patient's back, the safety guide part is made to stand to be held by the patient turning back and the opposite safety guide part is made to lie down for the carer to wash the patient's back. Accordingly, the patient's safety may be enhanced and the carer's convenience may be enhanced simultaneously.

Also, the special bearing rotated only in one direction and the angle adjusting handle provided in the headrest, engaging with the sprocket, may prevent the headrest from being drastically rotated in the downward direction. Accordingly, the patient's accident may be prevented advantageously.

Still further, the damping member is provided between the headrest and the bed to enable the gentle rotation of the headrest and to prevent the drastic rotation of the headrest.

Still further, the headrest is provided with the plurality of the members to be tilted. Accordingly, the patient's head can be supported stably and the water used in showering the patient can be prevented from flowing to the patient's face, without applying load to the patient's neck.

Still further, the headrest includes the opening formed in the outer end thereof and the water used in washing the patient's hair may be drained via the opening. Accordingly, it may be prevented that unnecessary water is flowing to the patient and the carer can wash the patient's hair conveniently.

Still further, the drive-assisting unit having the driving wheel selectively contacting with the ground according to the user's selection and the motor driving the driving wheel may be provided. When the shower carrier is moved, the driving wheel is driven to assist the movement of the shower carrier to enable the user to move the shower carrier with a small power. In this instance, the drive-assisting unit can adjust the position of the driving wheel via the driving link. It may be determined according to the user's selection whether to use the drive-assisting unit.

Still further, when the shower carrier is moved by the driving wheel elastically supported by the driving link, the contacting force with the ground may be increased and the shock generated by the state of the ground may be damped advantageously.

A speed measuring device may be further provided in the moving wheel to measure the rotation number of the moving wheel and the rotation number of the motor may be adjusted based on the measured rotation number. Accordingly, the drive-assisting unit may be used advantageously, when the moving speed of the shower carrier is not uniform.

Still further, the drive-assisting unit may further include the operation control part and the operation of the motor may be determined by the operation of the driving link. When the driving wheel is not in contact with the ground by the driving link, the motor is not operated. When the driving wheel is in contact with the ground by the driving link, the motor is operated. Accordingly, unnecessary electric energy waste may be reduced advantageously.

The effects of the present invention may not be limited by those effects mentioned above and other effects not mentioned above may be expected and understood from a range of claims by anyone skilled in the art to which the present invention pertains.

BEST MODE

As follows, embodiments will be described in detail, referring to the accompanying drawings.

First Embodiment

Figure 1:
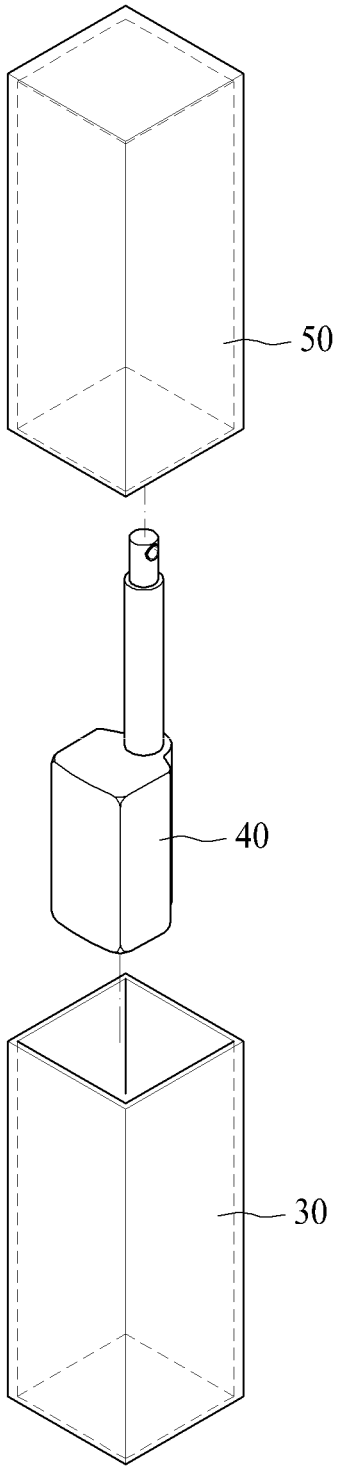
FIG. 1 PRIOR ART
FIG. 1 is a perspective view illustrating a housing part and an elevating module which are provided in a conventional shower carrier.
Figure 2:
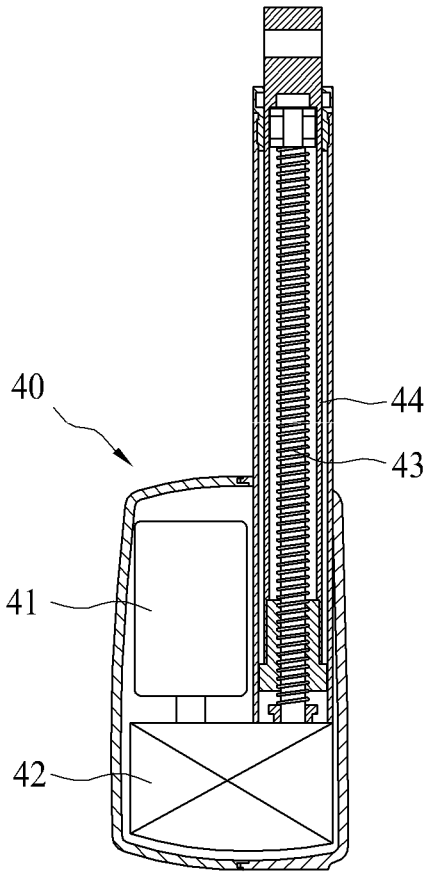
FIG. 2 PRIOR ART
FIG. 2 is a sectional view of the elevating module provided in the conventional shower carrier.
Figure 3:
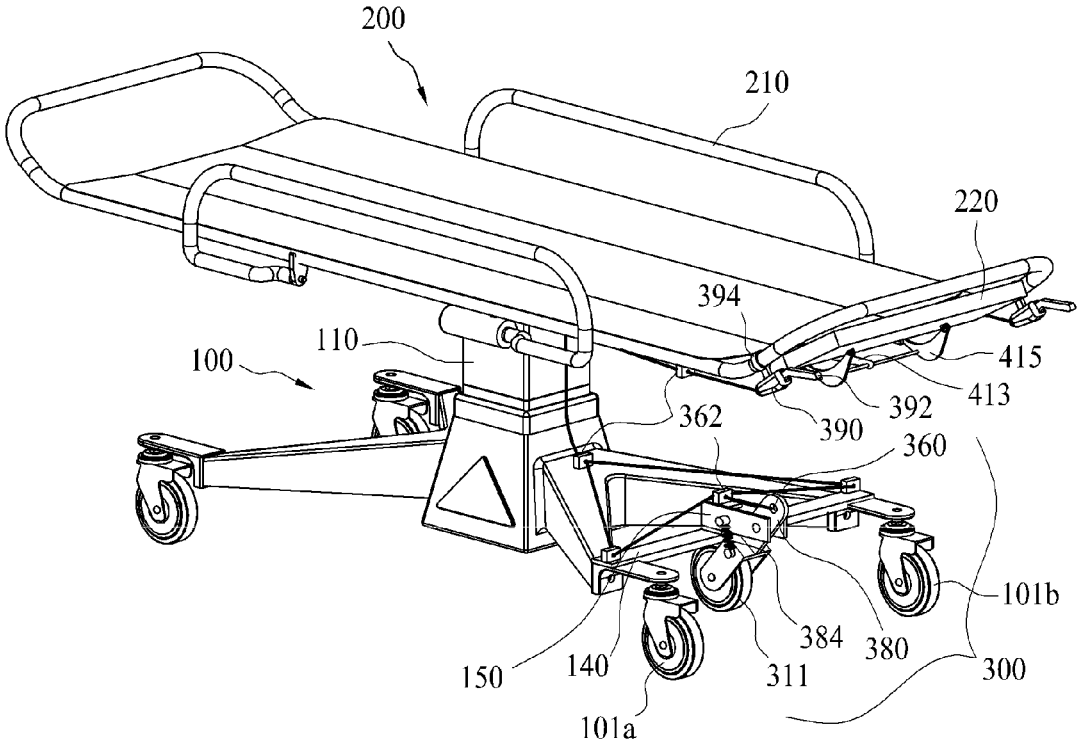
FIG. 3 is a perspective view schematically illustrating a structure of a shower carrier according to a first embodiment of the present invention.

FIG. 3 is a perspective view schematically illustrating a structure of a shower carrier according to a first embodiment of the present invention.

Referring to FIG. 3, the shower carrier according to this embodiment of the present invention includes a base frame 100, a housing part 110, a drive-assisting unit 300, a bed 200 and a headrest 400.

The structure of the base frame 100 may be changeable in various ways only when the base frame 100 can support the housing part 110 and the bed 200 stably. A plurality of wheels 101 may be provided in the base frame 100.

The housing part 110 is coupled to the base frame 100 and it may be expandable in an up and down direction by a plurality of housings 111, 112 and 113 (see FIG. 4) and an elevating module (120 and 130, see FIG. 4), to adjust the height of the bed 200. Accordingly, a carer can adjust the height of the bed 200 according to the environment or place where a patient is washed such that the carer can wash the patient in a more comfortable environment.

The bed 200 may be a sitting type or a lying type for the carer to be positioned comfortably. According to this embodiment, the bed 200 is a lying type to enable the carer to wash the patient lying thereon and it may be tilted at a predetermined angle to drain the water used in washing the patient to a side of the bed 200 when the carer washes the patient or it may be tilted at a predetermined angle that can be adjusted by the carer.

The bed 200 may include the safety guide part 210 in a side of the bed, next to the patient, to prevent the patient from falling out of the bed. A grip part 220 may be further provided in the other side having no safety guide part 210 and the grip part 220 may be gripped by the user.

A pair of safety guide parts 210 may be provided in predetermined portions of the bed 200, corresponding to each other, to support the patient and to prevent a safety accident.

The drive-assisting unit 300 may be provided with a driving link 380 rotatably coupled to at least one of the bed 200 and the base frame 100, a driving wheel 311 connected to the driving link 380 to be movable together with the wheel 101, and a motor (not shown) to provide a driving force to the driving wheel 311.

Positions of the driving wheel 311 and the driving motor are provided in the drive-assisting unit 300. Accordingly, after the position of the driving link 380 is adjusted, the driving wheel 311 and the motor of the drive-assisting unit 300 are operated and drive-assisting unit assists the drive of the shower carrier.

The headrest 400 is provided in an end of the bed 200 to support the head of the patient lying on the bed 200. At this time, an angle and a projected degree of the headrest 400 are adjusted. The driving unit 410 may adjust the angle and the projected degree of the headrest 400.

The operation and structure of the headrest 400 will be described later, referring to FIGS. 7 and 8.

Figure 4:
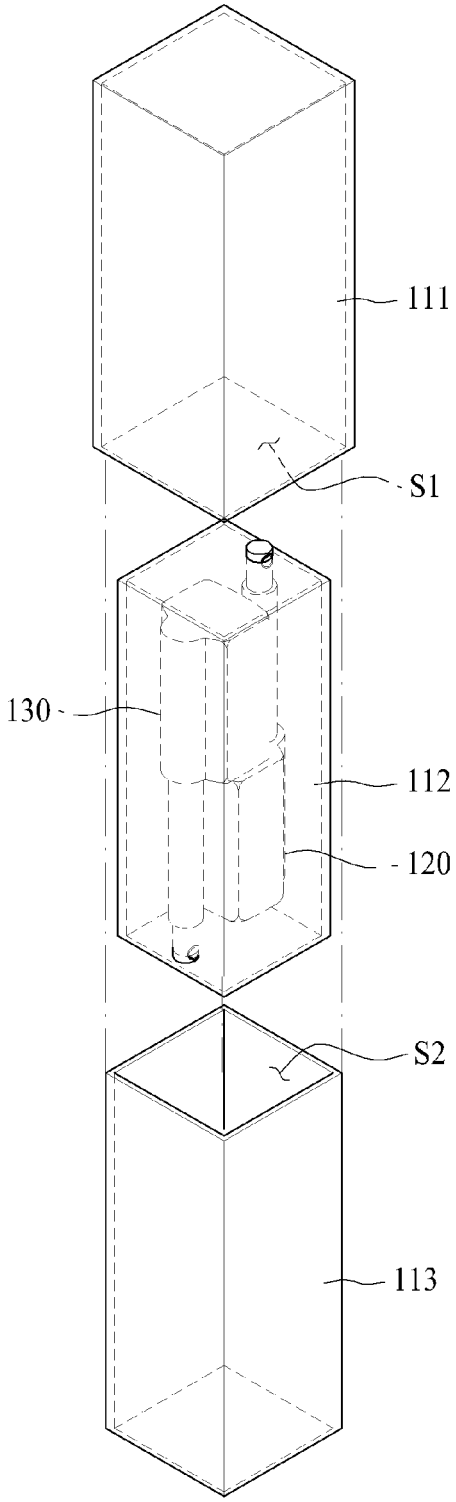
FIG. 4 is an exploded perspective view illustrating some parts of a housing part shown in FIG. 3.
Figure 5:
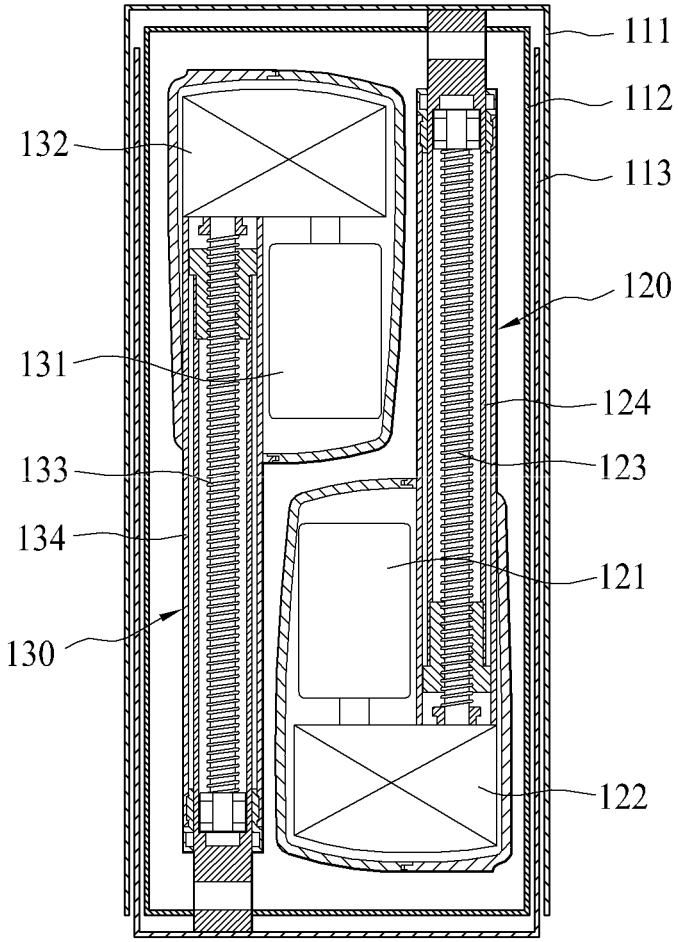
FIG. 5 is a sectional view of the housing part before a first elevating module and a second elevating module shown in FIG. 4 are expanded.
Figure 6:
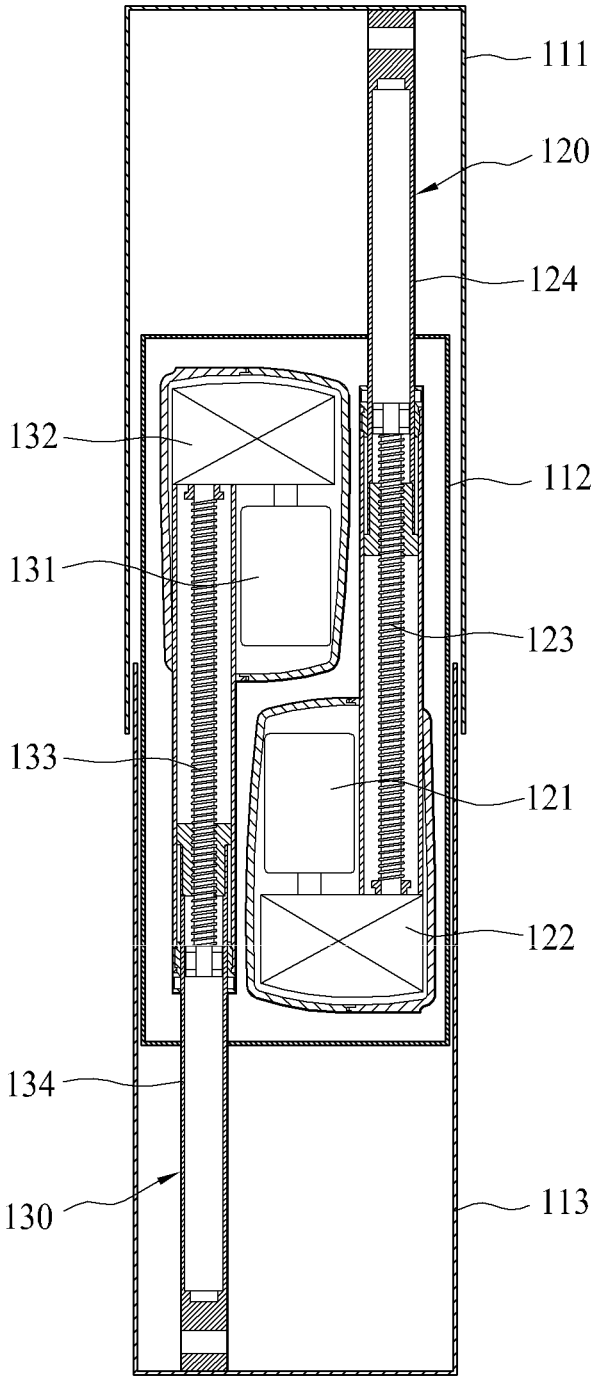
FIG. 6 is a sectional view of the housing part after the first elevating module and the second elevating module shown in FIG. 4 are expanded.

FIG. 4 is an exploded perspective view illustrating some parts of a housing part shown in FIG. 3. FIG. 5 is a sectional view of the housing part before a first elevating module and a second elevating module shown in FIG. 4 are expanded. FIG. 6 is a sectional view of the housing part after the first elevating module and the second elevating module shown in FIG. 4 are expanded.

Referring to FIGS. 4 to 6, the housing part 110 according to this embodiment includes a first housing 111, a second housing 112 and a third housing 113. The shower carrier according to the present invention includes a first elevating module 120 and a second elevating module 130.

In the housing part 110, an upper portion of the first housing 111 is connected to a lower portion of the bed 200 and the first housing 111 is provided to elevate to an upper portion of the second housing 112. The third housing 113 is provided to elevate to a lower portion of the second housing 112 and a lower portion of the third housing 113 is connected to the base frame 100. In other words, the housing part 110 includes the plurality of the housings which are overlapped with each other. Specifically, three housings 111, 112 and 113 are overlapped and coupled to each other in this embodiment.

Each of the housings 111, 112 and 113 may be various types only when it supports the bed 200 stably. According to this embodiment, each of the housings 111, 112 and 113 may be formed in a rectangular box. A lower surface of the housing 111 is open and a predetermined space (S1) is formed in the first housing 111 to accommodate the second housing 112. An upper surface of the third housing 113 is open and another predetermined space (S2) is formed in the third housing 113 to accommodate the second housing 112.

For example, a predetermined portion of the second housing 112 is accommodated in the space (S1) of the first housing 111 and the other portion of the second housing 112 is accommodated in the space (s2) of the third housing 113. In this embodiment, the space (S1) of the first housing 111 is larger than the space (S2) of the third housing 113. Accordingly, the second housing 112 is accommodated in the space (S2) of the third housing 113 and the third housing 113 is accommodated in the space (S1) of the third housing 111.

As a result, the heights of the first and third housings 111 and 113 may be formed identical to that of the second housing 112. The entire length of the housing part 110 which can be expandable may be increased. Meanwhile, in another embodiment, the space (S2) of the third housing 113 may be larger than the space (S1) of the third housing 111 and the first housing 111 may be positioned in the space of the third housing 113.

The space (S1) of the first housing 111 and the space (S2) of the third housing 113 may be formed in the corresponding shape to the housing accommodated in the spaces (S1 and S2). Accordingly, the housing accommodated in the spaces (S1 and S2) may be employed as a guide which guides the elevation of the third housing 113 toward the upper or lower portion of the third housing 113.

Specifically, in this embodiment, the space (S1) of the third housing 111 may be formed in the rectangular box shape corresponding to the shape of the second housing 112. The second housing 112 may be employed as the guide which guides the upward elevation of the first housing 111. The space (S2) of the third housing 113 may be formed in the rectangular box shape corresponding to the shape of the first housing 111 and the first housing 111 may be employed as the guide which guides the downward elevation of the third housing 113.

Moreover, various types of guide means such as a guide rail may be provided in circumferential portions of the first, second and third housings 111, 112 and 113, to guide more stable elevation of the first and third housings 111 and 113.

The elevating modules 120 and 130 include motors 121 and 131, power transmitting parts 122 and 132, fixing parts 123 and 133 and moving parts 124 and 134. In this embodiment, the first elevating module 120 and the second elevating module 130 are fixed in the second housing 112 in various ways. The first elevating module 120 and the second elevating module 130 may move the first housing 111 and the third housing 113, respectively. Meanwhile, the entire structures of the elevating modules 120 and 130 are identical to each other and the first elevating module 120 will be described in detail.

The motor 121 is provided with a shaft and it provides the rotation of the shaft to the power transmitting part 122. The power transmitting part 122 transmits a rotational force of the shaft provided in the motor 121 to the fixing part 123. Meanwhile, the motor 121 may directly rotate the fixing part 123, positioned under the fixing part. In this instance, the load of the bed 200 where the patient is positioned may be directly transmitted to the motor 121. Accordingly, the driving force of the motor 121 has to be large and the load might damage to the motor 121. When a predetermined size or more of the load is applied to the power portion of the fixing part 123, the motor 121 may be provided next to the fixing part 123 and it is common that the power transmitting part 122 such as a decelerator is provided to transmit the rotational force of the motor 121 to the fixing part 123.

The power transmitting part 122 may transmit the rotational force of the shaft rotating on the motor 121 to the fixing part 123. The power transmitting part 122 may be a variety of gear assemblies, considering the rotation number of the motor 121 and an elevating speed of the moving part 124 and the load applied to the upper portion of the power transmitting part.

The fixing part 123 is rotated on another shaft by the rotational force of the motor 121 transmitted thereto. In other words, as mentioned above, the motor 121 is positioned adjacent to the lateral surface of the fixing part 123 and the shaft of the fixing part 123 is not positioned on the line with the shaft of the motor 121. The fixing part 123 is rotated on a different shaft of the motor 121 from the shaft of the motor 121.

Specifically, the shaft of the motor 121 is arranged in parallel with the shaft of the fixing part 123. The power transmitting part 122 is connected to the motor 121 and the fixing part 123 and it can transmit the rotation of the shaft of the motor 121 to the fixing part 123.

The fixing part 123 may be longitudinally formed in a cylindrical shape and a screw thread is formed in a circumferential portion of the fixing part 123. The moving part 123 which will be described later moves the fixing part 123 along the rotation of the fixing part 123 in an upward and downward direction. Accordingly, the entire expandable length of the elevating module 120 may be determined based on the length of the fixing part 123.

A screw thread is formed to engage with the screw thread of the fixing part 123 and the moving part 124 may elevate the fixing part 123 in the upward and downward direction along the rotation of the fixing part 123. The first housing 111 is coupled to an end of the moving part 124 and the first housing 111 vertically elevates the third housing 113 along the movement of the moving part 124.

Meanwhile, the length of the fixing part 123 provided in the first elevating module 120 may determine the expanding degree of the elevating module 120. Accordingly, the length of the fixing part 123 is larger than the vertical length of the motor 121. Also, the motor 121 is connected to the surface connected to the lower surface of the fixing part 123. Accordingly, the horizontal width possessed by the lower portion of the first elevating module 120 may be formed larger than the horizontal width possessed by the upper portion of the first elevating module 120. Because of that, an empty space is formed in an upper area from the motor 120.

Accordingly, to utilize the empty spaces formed beyond the motor 121 and 131, the first elevating module 120 and the second elevating module 130 may be positioned between the motors 121 and 131 and the fixing parts 123 and 133 and the moving parts 124 and 134 are arranged to elevate in the reverse direction.

Considering the capacity of the motor and the damage to the motor 121 generated by the load of the bed 200 where the patient is located, the motor 121 may be arranged next to the fixing part. The second elevating module 130 is arranged in the empty space beyond the motor 121 in the reverse direction and the motor 131 of the second elevating module 130 is positioned, to increase space utilization.

As the first and second elevating modules 120 and 130 are arranged in the opposite direction, the moving parts 124 and 134 may be elevated vertically with respect to the second housing 112. Accordingly, the shape of the elevating module 120 and 130 is utilized as much as possible. Using the similar size and height of the housing part 110 to the conventional housing part of the prior art, the vertical displacement may be increased. The elevating distance of the bed 200 can be increased and the carer can wash the patient effectively.

The entire driving of the housing part 110 according to the first and second elevating modules 120 of the shower carrier will be described as follows.

Unless the first elevating module 120 and the second elevating module 130 are not expanded by no movement of the moving parts 124 and 134, the second housing 112 is accommodated by the space (S2) of the second housing not to be exposed outside and the third housing 113 is accommodated by the space (S1) of the first housing 111 not to be exposed outside. Accordingly, only the third housing 113 may be exposed outside.

The rotational force of the motor 121 provided in the first elevating module 120 is transmitted to the fixing part 123 via the power transmitting part 122 and the fixing part 123 is rotated accordingly. After that, the moving part 124 moves upwardly along the rotation of the fixing part 123. As the first housing 111 is moving upwardly, the bed 200 moves upwardly.

The third housing 113 connected to the end of the moving part 134 is moving downwardly according to the driving of the second elevating module 130 which is similar to the driving of the first elevating module 120. Specifically, the lower portion of the third housing 130 is coupled to the base frame 100 and the second housing 112 is moving upwardly according to the driving of the second elevating module 130, only to elevate the bed 200 upwardly.

As a result, the first elevating module 120 and the second elevating module 130 are arranged compact as the motors 121 and 131 are arranged adjacent to the fixing part. While the entire size of the overall housing part 110 including the second housing 112 is maintained similar to the size of the conventional housing according to the prior art, the first elevating module 120 and the second elevating module 130 are expanded in the opposite direction to move the first housing 111 and the third housing 113 in the opposite direction. Accordingly, the movable height of the bed 200 can be maximized.

Hence, referring to FIGS. 7 and 8, the operation of the headrest 400 will be described as follows.

Figure 7:
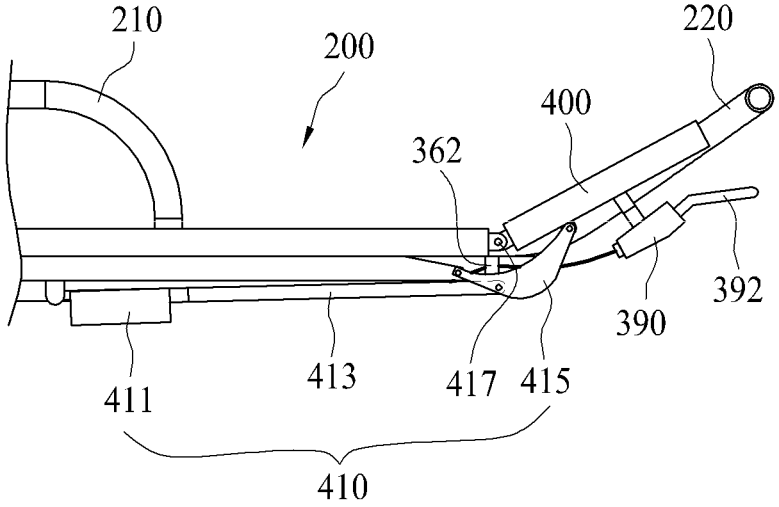
FIG. 7 is a diagram illustrating a state where a headrest is tilted upwardly by a driving unit of FIG. 3.

FIG. 7 is a diagram illustrating a state where the headrest is tilted upwardly by the driving unit of FIG. 3. FIG. 8 is a diagram illustrating a state where the headrest is tilted downwardly by the driving unit of FIG. 3.

Figure 8:
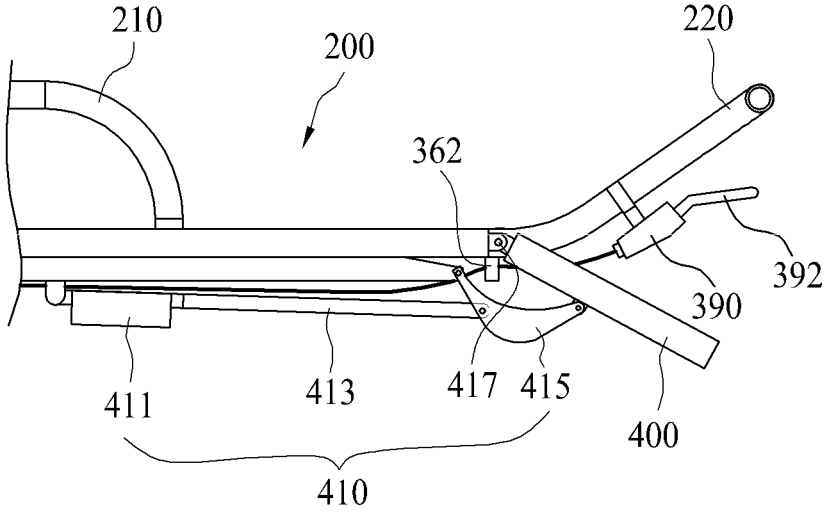
FIG. 8 is a diagram illustrating a state where the headrest is tilted downwardly by the driving unit of FIG. 3.

As shown in FIGS. 7 and 8, the driving unit may include a hinge part 417, an actuator 411, an arm 413 and a bracket 415.

The hinge part 417 may rotatably couple an end of the headrest 400 to the bed 200.

The actuator 411 is provided in a lower portion of the bed 200 and it may be selectively expandable by the operation of the carer.

The arm 413 may be coupled to the actuator 411 and it may be extended a predetermined length toward the headrest 400 and it may be pushed or pulled according to the extension of the actuator 411.

In addition, an end of the bracket 415 may be rotatably coupled to the lower portion of the bed 200 and the other end thereof is hingedly coupled to the hinge part 417 of the headrest 400, spaced apart from the hinge part. An end of the arm 413 is hingedly coupled between the ends of the bracket 415. The other end of the bracket 415 is formed higher than the end of the bracket 415 and the portion of the bracket where the arm 413 is coupled is formed lower than the end of the bracket. Accordingly, when it is pushed or pulled, the arm 413 is rotated on the end of the bracket 415 to adjust the angle and projected degree of the headrest 400.

As shown in FIGS. 7 and 8, when the actuator 411 is expanded to enable the arm 413 to push the bracket 415, the headrest 400 is stood straight to be projected. When the actuator 411 is retracted to enable the arm 413 to pull the bracket 415, the headrest 400 is tilted downwardly.

When trying to stand the patient's head straight, the carer makes the headrest 400 projected. When trying to bend the patient's head back, the carer makes the headrest 400 tilted downwardly. In addition, the carer adjusts the extension degree of the actuator 411 to adjust the projected degree of the headrest 400 and the angle of the headrest 400, such that the carer may adjust the headrest 400 according to the patient's body shape.

Also, the headrest 400 need not support the patient's head. If the patient is lying on the bed 200 in the reverse direction or if the headrest 400 is provided in each end of head and foot portions of the bed 200, the headrest 400 may support the patient's feet. The patient can make the feet rested on the headrest 400 when the headrest 400 is projected. When the headrest 400 is tilted downwardly, the feet portion is distant from a supporting surface in parallel and the headrest 400 can be used when washing the patient's feet.

Figure 9:
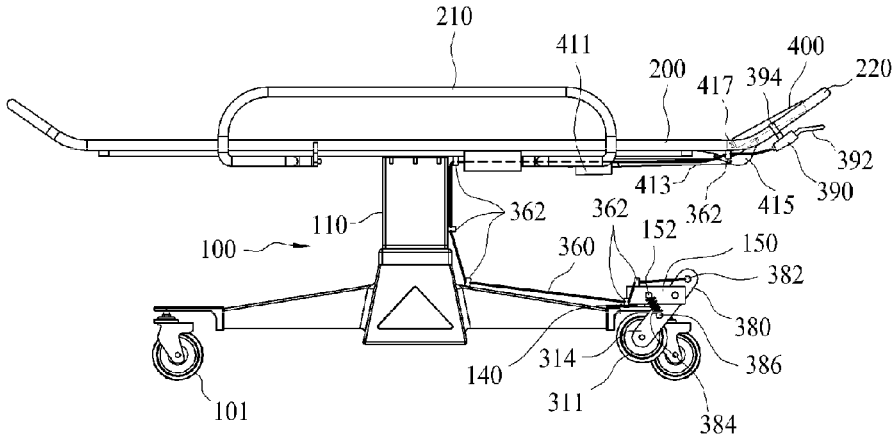
FIG. 9 is a state diagram illustrating side driving and pausing of a drive-assisting unit shown in FIG. 3.
Figure 10:
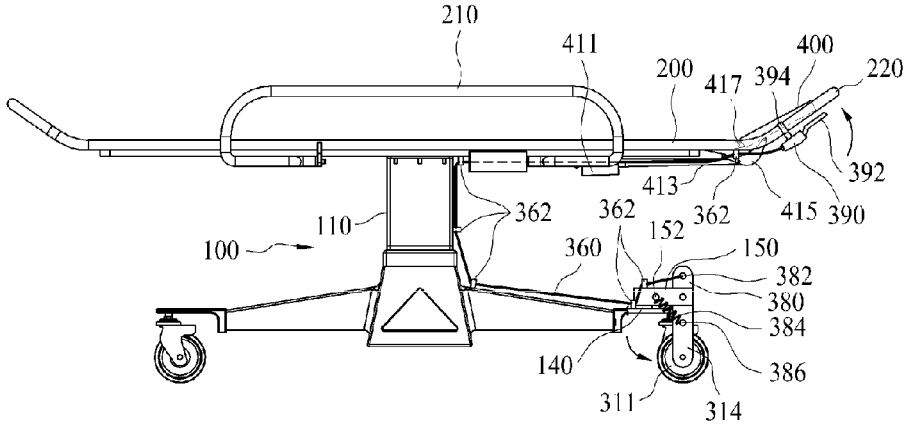
FIG. 10 is a diagram illustrating linear driving of the drive-assisting unit shown in FIG. 3.

Referring to FIGS. 9 and 10, the structure and operation of the drive-assisting unit 300 will be described as follows.

FIG. 9 illustrates a lateral surface driving state a standing still state of the drive-assisting unit 300 shown in FIG. 3. FIG. 10 illustrates a linear driving state of the drive-assisting unit 300 shown in FIG. 3.

The drive-assisting unit 300 may enable the user to contact the driving wheel 311 with the ground according to the operation of the driving link 380.

When the driving wheel 311 is in contact with the ground by the driving link 380, the motor is put into operation and the driving wheel 311 is rotated by the operation of the motor to assist the movement of the shower carrier.

In this embodiment, the drive-assisting unit 300 may include a couple of levers 390 coupled to the grip part 220 formed to partially surround an outer surface of the bed 200, spaced apart a predetermined distance from the outer surface, and a wire 360 having both ends coupled to the levers 390 and the driving link 380, respectively.

As shown in the drawings, the base frame 100 may further include an auxiliary frame 140 to position the driving wheel 311 between the first wheel 101 and the second wheel 101*b*. The driving link 380 is coupled to a middle portion of the auxiliary frame 140.

The bracket 150 is provided in the middle portion of the auxiliary frame 140 and the driving link 380 is rotatable coupled to the auxiliary bracket 150. The driving wheel 311 and the motor may be coupled to a lower end of the driving link 380.

In this instance, at least one of the auxiliary bracket 150 and the auxiliary frame 140 and the lower end of the driving link 380 are coupled to both ends of a restitution member 384, respectively, to make the driving wheel 311 not contact with the ground in a state where an external force is not applied.

In this embodiment, a first fixing projection 152 is projected from the auxiliary bracket 150 and a second fixing projection 386 is projected from the driving link 380. An end of the restitution member 384 is coupled to the first fixing projection 152 and the other end thereof is coupled to the second fixing projection 386.

The first fixing projection 152 and the second fixing projection 386 are coupled to the restitution member 384, such that the motor and the driving wheel 311 may not contact with the ground when an auxiliary external force is not applied to the driving link 380 by the tensile force applied to the driving link 380 and the auxiliary bracket 150.

The levers 390 may be operable by the user selectively and the levers 390 may partially surround the grip part 220 such that a predetermined portion of the grip part 220 may be thoroughly fixed.

The drive-assisting unit 300 having the structure mentioned above may further include a wire 360 connecting the levers and the driving link 380 with each other to enable the user to operate the levers 390 to adjust the operation state of the driving link 380.

An end of the wire 360 is coupled to a lever 392 provided in the lever 390 and the other end of the wire 360 is coupled to a connection groove 382 formed in an upper end of the driving link 380.

The wire 360 connects the driving link 380 and the lever 390 with each other and the external force generated by the operation of the lever 390 is transmitted to the driving link 380. The external force transmitted via the wire 360 may rotate the driving link 380.

At this time, the wire 360 has to transmit the external force generated by the lever 390 to the driving link 380 as it is and it may be formed of an elastic material.

As the structure of the lever 390 will be described in detail, the lever 390 includes a coupling ring 394 positioned in a high portion thereof to be coupled to the grip part 220 of the bed 200 and a lever 392 rotatable coupled to a lower portion thereof to transmit the external force to the wire 360.

The coupling ring 394 is formed to cover the grip part 220 to thoroughly fix a predetermined portion of the grip part 220 to the bed 200.

The lever 392 is rotatable coupled to the lower portion of the body, to adjust the external force transmitted to the wire 360 according to an operational state of the lever 392.

Accordingly, the lever 392 coupled to the wire 360 may adjust the operational state of the driving link 380.

Meanwhile, a plurality of fixing members 362 may be provided in a predetermined portion of the outer surface of the base frame 100 or the lower surface of the bed 200, where the wire 360 is positioned, spaced apart from each other, to prevent the wire 360 from separating from the base frame 100 and the bed 200.

The wire 360 fixed by the fixing member 362 may not be separated and it may transmit the external force generated from the lever 390 to the driving link 380.

As shown in FIG. 9, the driving link 380 is rotated toward the auxiliary frame 140 to be fixed by the restitution member 384 when the external force is not applied to the lever 390 in the drive-assisting unit 300 as shown in FIG. 9.

The driving link 380 is rotated toward the auxiliary frame 140 to be fixed. Accordingly, the driving wheel 311 coupled to the lower end of the driving link 380 is spaced apart a predetermined distance from the ground not to interfere with the drive of the shower carrier.

Next, as shown in FIG. 10, when the external force is applied to the lever 390, the driving link 380 is provided with the external force via the wire 360 connected with the lever 390.

After the external force is transmitted to the driving link 380 via the wire 360, the driving link 380 is rotated on the shaft coupled to the auxiliary bracket 150 in a counter-clockwise direction. At this time, the driving link 380 is fixedly supported by the restitution member 384 and the external force applied to the driving link 380 has to be stronger than the elastic force of the restitution member 384.

When the driving link 380 is rotated by the transmitted external force, the driving wheel 311 connected with the driving link 380 is in contact with the ground and it assists the driving of the shower carrier.

At the same time, the driving wheel 311 is in contact with the ground and the motor connected with the driving wheel 311 generates a driving force to transmit the driving force to the driving wheel 311.

The moving wheel 101 includes a sensor (not shown) for measuring the rotation number thereof.

Also, the rotation number of the motor may be adjustable and it may be determined according to the rotation number measured by the sensor provided in the moving wheel 101.

In this embodiment, the operation of the driving link 380 is adjusted by the lever 390. However, instead of the lever 390, the driving link 380 is extended to form an auxiliary operation handle at an outer end thereof to operate the driving link 380. Also, an auxiliary operation part may be provided in the operation handle part to control the operation of the motor.

Any structures that enable the user to operate the driving link 380 may be applicable, not limited to the structure mentioned above.

Accordingly, the user can selectively control the moving speed of the shower carrier according to this embodiment and the shower carrier can be used conveniently.

Although not shown in the drawings, the drive-assisting unit 300 may include an auxiliary operation control part (not shown) to determine whether to operate the motor according to an operation state of the driving link 380 controlled by the user.

The operation control part may control whether to operate the motor according to various methods such as a rotational state of the driving link 380 or the distance between the driving link 380 and the base frame.

Hence, referring to FIG. 11, the structure in which the driving link 380 elastically supports the driving wheel 311 will be described as follows.

Figure 11:
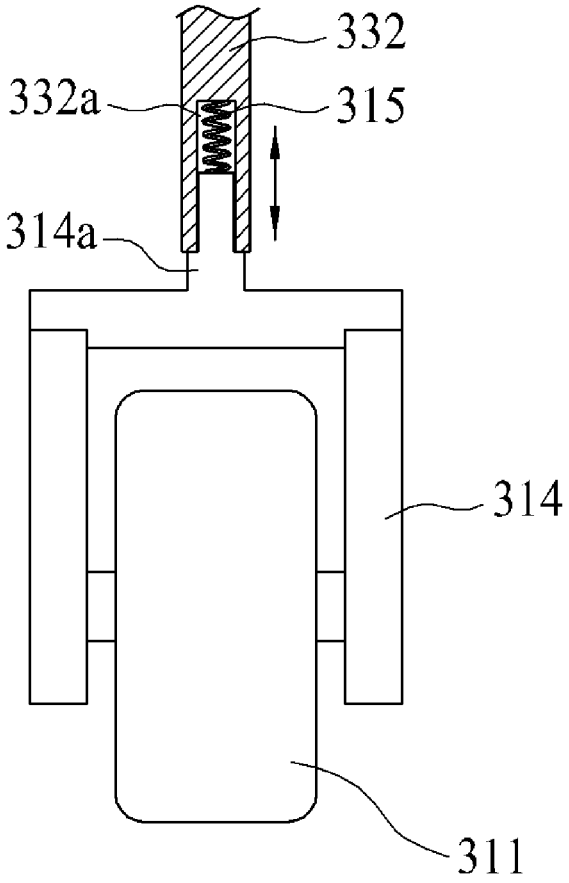
FIG. 11 is a sectional view illustrating a driving link of FIG. 3 that elastically supports a driving wheel.

FIG. 11 is a sectional view illustrating the structure of the driving link supporting the driving wheel elastically.

The driving link 380 is coupled to a supporting jacket 314 and the supporting jacket 314 has the motor (not shown) positioned therein to provide a driving force outside. At this time, the driving link 380 includes an elastic supporting member 315 provided in a lower end thereof to be coupled to the supporting jacket 314.

Specifically, an inserting groove 382 is provided in the lower end of the driving link 380 and an inserting guide **314*a* provided in the supporting jacket 314 slidingly is inserted in the inserting groove 382 of the driving link 380**.

A side of the elastic supporting member 315 is connected to the inserting guide **314*a* and the other side of the elastic supporting member 315 is connected to the inserting groove 382, to position the elastic supporting member 315 in the driving link 380**.

The elastic supporting member 315 causes an effect of preventing the shock transmitted via the driving wheel 311 from being transmitted to the bed 200.

In this embodiment, the elastic supporting member 315, the inserting groove **332*a* and the inserting guide 314*a* may be provided to elastically support the driving wheel 311. However, a hydraulic damper, a pneumatic damper and a spring may be applied to elastically support the driving wheel 311. The present invention may not be limited thereto and any structures capable of dampening the shock transmitted via the driving wheel 311** from the ground may be applicable.

Figure 12:
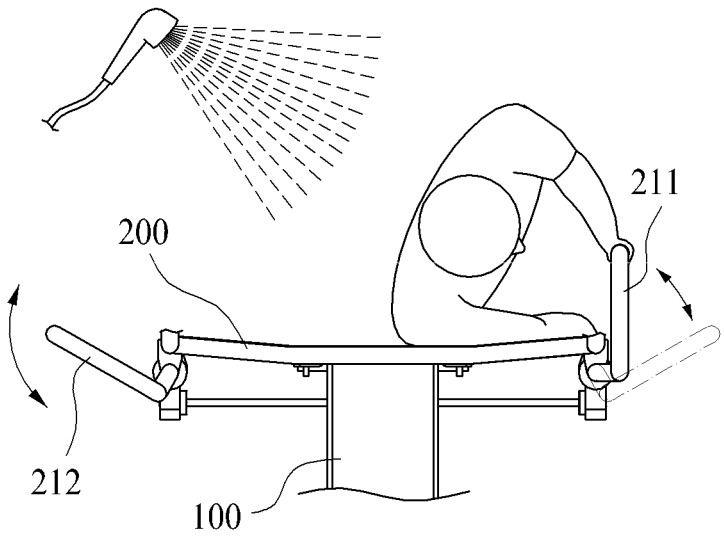
FIG. 12 is a diagram illustrating a state where a safety guide part rotates to operate independently.

Referring to FIG. 12, the operation of the safety guide 210 will be described as follows.

FIG. 12 is a diagram illustrating a state where the safety guide part of FIG. 3 is independently operated by the rotation.

The safety guide part 210 includes a first safety guide 211 provided in a predetermined portion of the bed 200, a second safety guide 212 provided in an opposite portion of the bed 200 and a safety guide driving part (not shown).

The first safety guide 211 and the second safety guide 212 may lie down or stand straight as they are rotated with respect to the bed 200 or the base frame 100. At this time, the first safety guide 211 and the second safety guide 212 may be independently made to lie down or stand up.

The safety guide driving part is configured to make down or stand the first safety guide 211 and the second safety guide 212, independent from each other.

As shown in the drawing, the first safety guide 211 and the second safety guide 212 can be laid down or stood up, independent from each other. When trying to turn the patient back to wash the patient's back, the first safety guide 211 positioned adjacent to the patient is stood up to be grasped by the patient and the second safety guide 212 positioned in the opposite direction is laid down for the carer to wash the patient's back conveniently. Accordingly, the patient's safety may be enhanced and the carer's washing convenience may be also enhanced.

Figure 13:
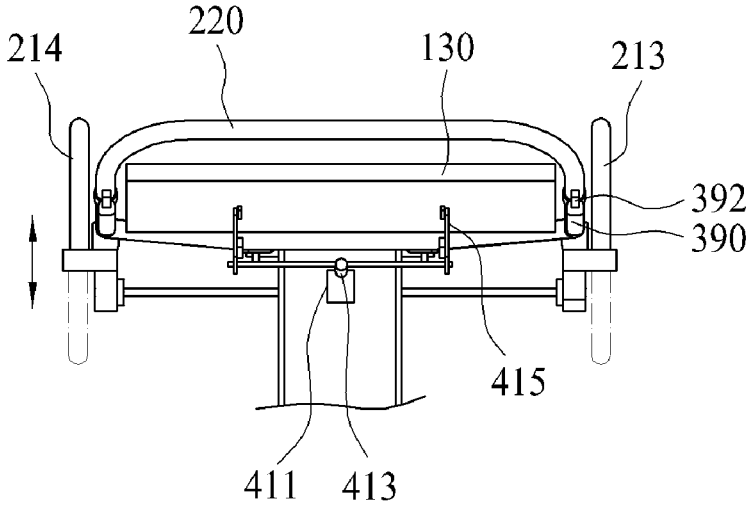
FIG. 13 is a diagram illustrating a shower carrier having a structure where the safety guide of FIG. 3 is sliding upwardly and downwardly.

Referring to FIG. 13, a variation of the safety guide part 210 will be described as follows.

The safety guide part 210 may be made stand up selectively while sliding vertically, rather than the method of making the safety guide part lie down or stand up while being rotated.

FIG. 13 is a diagram illustrating a shower carrier having the safety guide part that is able to slide vertically.

The safety guide part 210 may include a first safety guide 213 provided in a side of the bed 200 and a second safety guide 214 provided in opposite to the first safety guide 213.

The first safety guide 213 and the second safety guide 214 are able to slide vertically. In other words, when sliding upwardly, the first and second safety guides 213 and 214 are made stand up to be projected beyond the bed 200 to prevent the patient from falling. When they are sliding downwardly, the first and second safety guides are sliding below the bed 200 to enable the patient to get on the bed or to be washed without any inconvenience.

In addition, a safety guide driving part may be further provided to make the first safety guide 213 and the second safety guide 214 sliding vertically, independent from each other.

Accordingly, the first safety guide 213 and the second safety guide 214 are sliding vertically to stand up independently. When the carer trying to turn the patient back to wash the patient's back, the patient grasps the standing safety guide. The carer lays the other safety guide down to minimize the interference with the washing.

In addition, the patient may be closer to the bed, compared with a conventional bed, when getting on or off the shower carrier, and the moving distance of the shower carrier is relatively shorter enough to reduce the carer's efforts of moving the patient. Also, there may be another effect of reducing the possibility of the patient falling between the bed and the shower carrier.

Second Embodiment

Referring to FIGS. 14 to 18, a second embodiment of the present invention will be described as follows.

Figure 14:
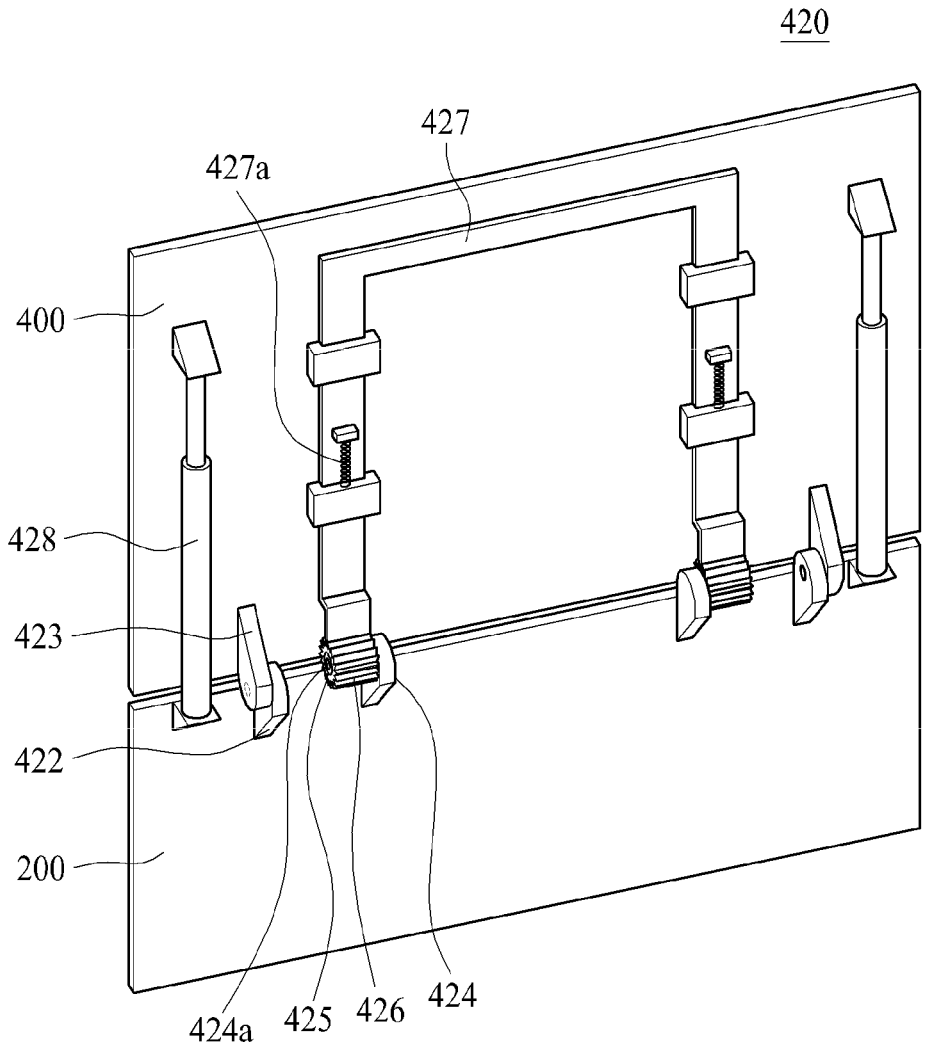
FIG. 14 is a perspective view illustrating a structure of a headrest according to a second embodiment of the present invention.

First of all, FIG. 14 is a perspective view of a headrest according to the second embodiment of the present invention.

Referring to FIG. 14, a basic structure of the headrest is identical to the basic structure according to the first embodiment and an auxiliary coupling unit 420 is provided, instead of the driving unit 410.

The headrest 400 is provided in an upper portion of the bed 200 and the patient's head is positioned on the headrest 400 when the patient is lying down on the bed. A side of the headrest 400 is hingedly coupled to the bed 200 to enable the headrest 400 to be rotatable upwardly or downwardly with respect to the bed 200.

The coupling unit 420 includes a first bed coupling part 422, a head coupling part 423, a second bed coupling part 424, a special bearing 425, a sprocket 426 and an angle adjusting handle 427.

The first bed coupling part 422 is projected toward the bed 200 and a coupling hole (422*a*, see FIG. 15) may be formed in a predetermined portion of the first bed coupling part 422.

The head coupling part 423 is projected from the headrest 400 and a first shaft (423*a*, see FIG. 15) may be formed in the head coupling part 423 to be inserted in the coupling hole 422*a*.

The second bed coupling part 424 may be projected toward the bed 200 and a second shaft 424*a* may be formed in a predetermined portion of the second bed coupling part 424.

Figure 16:
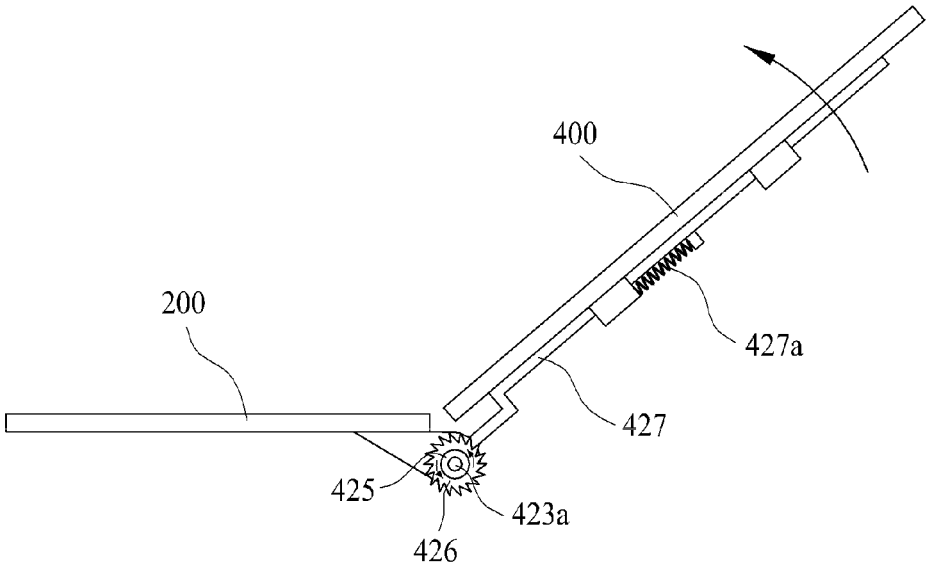
FIG. 16 is a sectional view schematically illustrating a position of a sprocket 426 when the headrest of FIG. 14 is rotated in an upward direction.

FIG. 16 is a sectional view schematically illustrating the position of the sprocket 426, when the headrest 400 of FIG. 14 is rotated upwardly.

Figure 17:
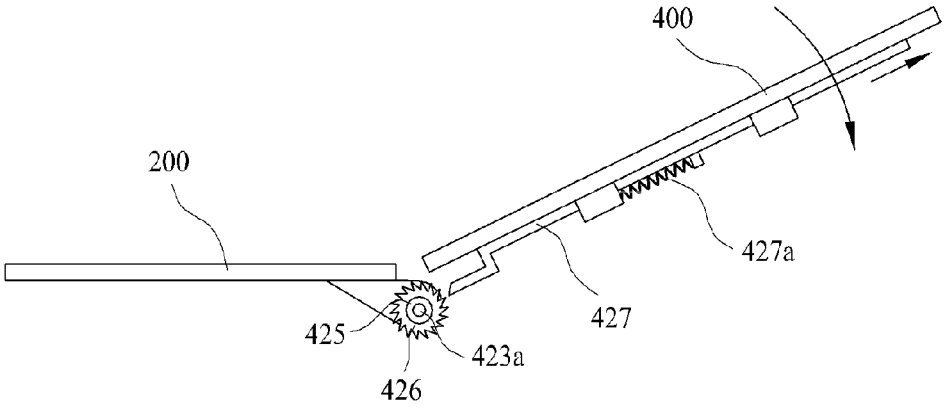
FIG. 17 is a sectional view schematically illustrating a position of the sprocket 426 when the headrest of FIG. 14 is rotated in a downward direction.

FIG. 17 is a sectional view schematically illustrating the position of the sprocket 426, when the headrest 400 of FIG. 14 is rotated downwardly.

As shown in FIGS. 16 and 17, the special bearing 425 is coupled to the second shaft 424*a* to enable the headrest 400 to be rotatable only in an upward direction, not in a downward direction.

The sprocket 426 is coupled to an outer surface of the special bearing 425 to rotate together with the rotation of the special bearing 425 when the headrest 400 is rotated upwardly and not to rotate when the headrest 400 is rotated downwardly.

The angle adjusting handle 427 is provided in a predetermined portion of the headrest 400 and a side of the angle adjusting handle 427 may engage with the sprocket 426.

A predetermined portion of the angle adjusting handle 427 can be pulled a predetermined distance by the carer's hand. When the headrest 400 is rotated upwardly, the angle adjusting handle 427 may engage with the sprocket 426 to be rotated together with the headrest 400. Also, when trying to rotate the headrest 400 downwardly, the carer may pull the angle adjusting handle 427 upwardly to separate it from the sprocket 426 and rotate the headrest 400 downwardly.

As shown in FIG. 14, an elastic member 427*a* may be provided in a predetermined portion of the angle adjusting handle 427 to provide an elastic force toward the portion where the angle adjusting handle 427 and the sprocket 426. Accordingly, even if the carer misses the headrest 400 or the angle adjusting handle 427, the angle adjusting handle 427 may re-engage with the sprocket 426 by the elastic member 427*a* to prevent the headrest 400 from rotating in the downward direction drastically.

As shown in FIG. 14, a damping member 428 may be provided between the headrest 400 and the bed 200. Accordingly, the headrest 400 may be rotated gently and a shock which might be applied to the patient's neck by the drastic rotation of the headrest 400 may be prevented. At this time, the damping member 428 may be a hydraulic damper, a pneumatic damper or a spring. However, the present invention is not limited thereto and any types of dampers may be applicable only if they can prevent the drastic rotation of the headrest 400.

The coupling unit 420 according to the second embodiment of the present invention may further include a stopper that enables the headrest 400 to be rotatable within a range of predetermined angles.

Figure 15:
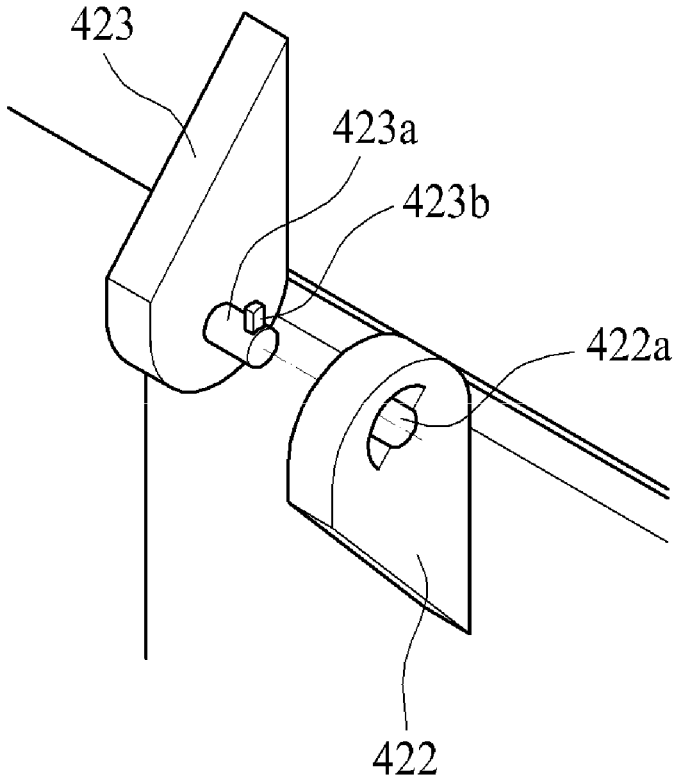
FIG. 15 is an exploded perspective view of a first bed connecting part and a head connecting part which are provided in a connection unit of FIG. 14.

FIG. 15 is an exploded perspective view of the first bed coupling part and the head coupling part that are provided in the coupling unit of FIG. 14.

As shown in FIG. 15, the stopper may be provided with a key 423*b* provided in the first shaft 423*a* and a key groove formed in the coupling hole 422*a*. Accordingly, the first shaft 423*a* may be rotatable in an angle at which the key groove is formed, to limit the rotation angle of the headrest 400.

Figure 18:
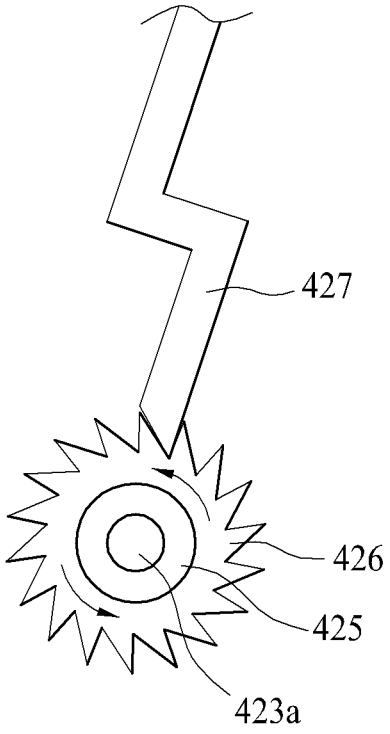
FIG. 18 is an enlarged sectional view of the sprocket provided in the connection unit of FIG. 14.

FIG. 18 is an enlarged sectional view of the sprocket provided in the coupling unit of FIG. 14.

As shown in FIG. 18, a side of cross section possessed by a sawtooth of the sprocket 426 has is short and the other side thereof is long in asymmetry. Accordingly, when the headrest 400 tries to rotate downwardly, the angle adjusting handle 427 is supported by the short sawtooth surface of the headrest 400 and the downward rotation of the headrest 400 can be limited more effectively.

At this time, the engaging portion between the angle adjusting handle 427 and the sprocket 426 may be formed in a corresponding shape to the shape of the space between neighboring sawteeth.

As shown in FIG. 14, a pair of coupling units 420 may be provided to endure the load of the patient applied to the headrest 400. When the pair of the coupling units 420 are provided, the secure coupling and damping effect can be gained.

As shown in FIG. 14, the damping member 428 may be provided in each of both sides of the coupling unit 420. Although not shown in the drawing, the damping member 428 may be provided between the pair of the coupling units 420.

Referring to FIGS. 16 and 17, the operation of the headrest 400 according to the second embodiment will be described as follows.

The first shaft 423*a* is rotated together with the rotation of the headrest 400. The second shaft 424*a* belongs to the bed 200 and it is not rotated, regardless of the rotation of the headrest 400.

As shown in FIG. 16, when the headrest 400 is rotated upwardly, the first shaft 423*a* is rotated and the sprocket 426 engaging with the side of the angle adjusting handle 427 is rotated by the angle adjusting handle 427 coupled to the headrest 400. At this time, the rotation of the special bearing 425 is generated.

When the rotation of the headrest 400 is stopped, the downward rotation of the headrest 400 is limited by the special bearing 425 and the angle adjusting handle 427. The sprocket 426 and the angle adjusting handle 427 engage with each other and the downward rotation of the headrest is limited by the special bearing 425, such that the headrest 400 may maintain the stopped state.

As shown in FIG. 17, when trying to rotate the headrest 400 downwardly, the carer may pull the angle adjusting handle 427 to release the engaging state between the sprocket 426 and the angle adjusting handle 427. The headrest 400 and the bed 200 are hingedly coupled to each other only by the first bed coupling part 422, only to generate the downward rotation of the headrest 400. At this time, the drastic rotation of the headrest 400 is prevented by the damping member 428 and the headrest 400 is rotated gently. Accordingly, the patient may feel more comfortable when using the headrest 400.

The second embodiment having the structure mentioned above is similar to the first embodiment and only the operation method of the headrest 400 is different.

Third Embodiment

Figure 19:
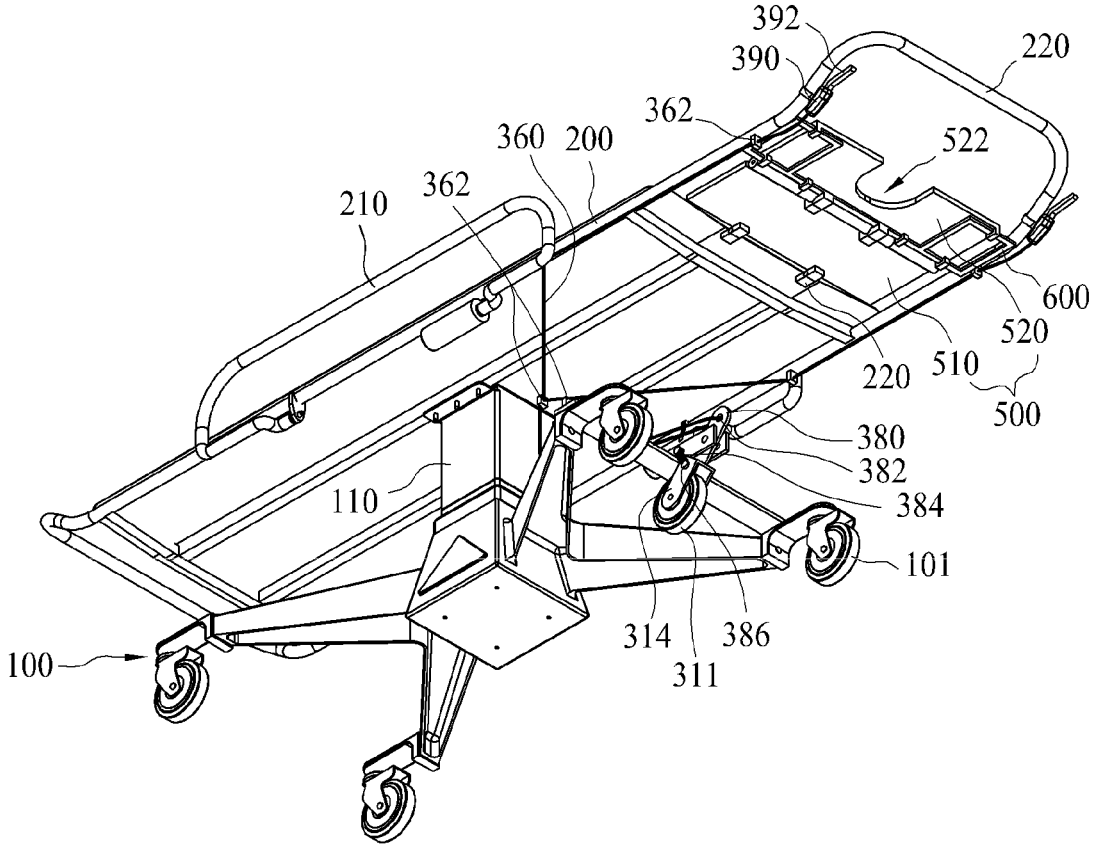
FIG. 19 is a perspective view schematically illustrating a shower carrier according to a third embodiment of the present invention.

Referring to FIG. 19, a third embodiment of the present invention will be described as follows. A basic structure of the third embodiment is similar to the basic structure of the first embodiment described above, except the structure of the headrest.

FIG. 19 is a perspective view schematically illustrating the structure of the third embodiment of the present invention.

As shown in FIG. 19, the headrest 500 is rotatably coupled to an end of the bed 200 and it is provided with a plurality of members that can be tilted independently by the user's operation. According to this embodiment, a pair of headrests 500 may be provided and the pair of the headrests 500 may be rotatably coupled to the end of the bed 200. The headrest 500 includes a neck supporting member 510 supporting the patient's neck and an auxiliary supporting member 520 rotatably coupled to the neck supporting member 510.

When the patient lies down on the top surface of the bed 200, a back side of the patient's neck is positioned on the neck supporting member 510 and the neck supporting member 510 supports the patient's neck.

The auxiliary supporting member 520 is positioned outer to the neck supporting member 510 in a longitudinal direction and it is tiltedly coupled to the neck supporting member 510. At this time, the auxiliary supporting member 520 supports an upper portion of the patient's head.

The auxiliary supporting member 520 has an opening 522 provided in an outer end portion. When washing the patient's hair on the bed 200, a person can wash a back side of the patient's hair via the opening easily. Also, the when the carer washes the patient's hair, the water used in washing the hair may be directly drained via the opening 522 without flowing along the patient's face or a back of the patient's neck.

A tilting operation part 600 is positioned in a coupling area of the neck supporting member 510 and the auxiliary supporting member 520, and the tilting operation part 600 may operate the tilting of the auxiliary supporting member 520.

In this embodiment, the tilting operation part 600 is positioned in a lower side surface of the auxiliary supporting member 520 to operate whether to tilt the auxiliary supporting member 520 according to the user's selection.

A side of the neck supporting member 510 provided in the shower carrier having the structure mentioned above is rotatably coupled to the outer end of the bed 200. Next, referring to FIG. 20, the operation of the headrest 500 will be described as follows.

Figure 20:
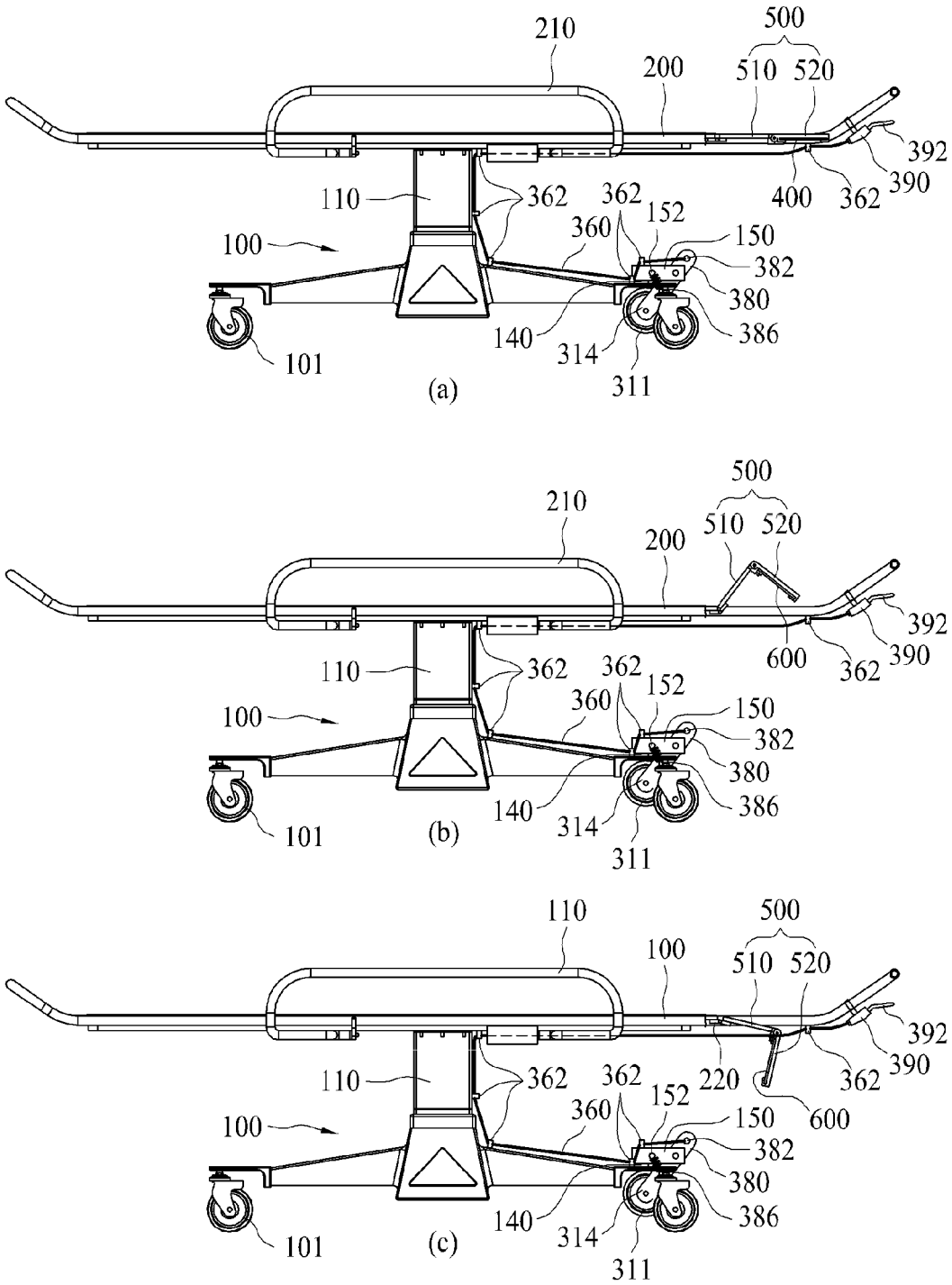
FIG. 20 is a diagram illustrating a state where the headrest of FIG. 19 is operated.

FIG. 20 is a diagram illustrating that the headrest of FIG. 19 is operated.

As shown in FIG. 20 (*a*), the headrest 500 is in parallel to the bed 200, not operated by the external force.

Hence, as shown in FIG. 20 (*b*), the neck supporting member 510 is tilted upwardly by the user's operation and the auxiliary supporting member 520 is tilted in a different direction from the neck supporting member 510 by the tilting operation part 600.

When the headrest 500 is tilted, the patient's head is lifted upwardly and an end of the head is not in contact with the auxiliary supporting member 520. Accordingly, an empty space is formed behind the end of the patient's head and the carer can easy the patient's hair via the space easily.

Meanwhile, as shown in FIG. 20 (*c*), the neck supporting member 510 is tilted in the downward direction by the user's operation. Together with the tilting, the auxiliary supporting member 520 is silted in the same direction by the operation of the tilting operation part 600.

Once the headrest 500 is tilted, the patient's head seated on the bed 200 is supported by the neck supporting member 510 and it is tilted downwardly not to contact with the auxiliary supporting member 520.

Basically, FIG. 20 (*b*) is similar to FIG. 20 (*c*) and the tilting direction of the neck supporting member 510 in FIG. 20 (*b*) is different from in FIG. 20 (*c*). That is to adjust the tilting according to the carer's taste or physical structure selectively.

Figure 21:
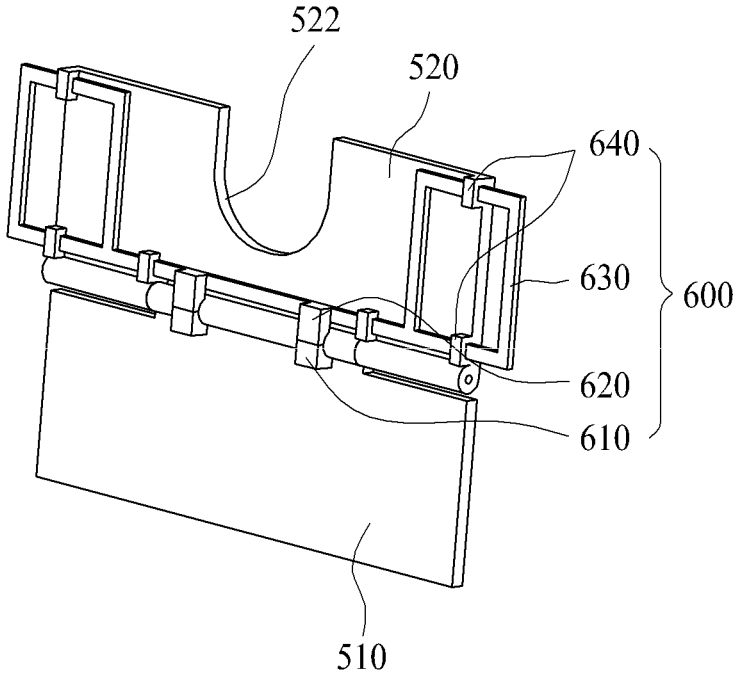
FIG. 21 is a perspective view illustrating a structure of a tilting operation part shown in FIG. 19.

Referring to FIG. 21, the operation of the tilting operation part 600 will be described as follows.

FIG. 21 is a perspective view illustrating the structure of the tilting operation part shown in FIG. 19.

The tilting operation part 600 includes a fixing member 610, a moving member 620 and an operation frame 630.

A plurality of fixing members 610 may be provided in an outer end of a lower surface of the neck supporting member 510 in a longitudinal direction. According to this embodiment, a pair of fixing members 610 may be provided.

The operation frame 630 is positioned in a lower lateral surface of the auxiliary supporting member 520 and it is movable along a horizontal direction. In this embodiment, the operation frame 630 can be sliding along a horizontal direction of the auxiliary supporting member 520, not separated by a plurality of sliding guides 640 provided in a lower surface of the auxiliary supporting member 520.

The moving member 620 is positioned in a center of the operation frame 630 and it is selectively contactable with the fixing member 610.

The moving member 620 is coupled to the operation frame 630 and the contact with the fixing member 610 is determined according to an operation state of the operation frame 630.

The tilting operation part 600 having the structure mentioned above may enable the user to operate the tilting of the neck supporting member 510 and the auxiliary supporting member 520 selectively.

The number of the moving members and the fixing members 610 is not limited and it is preferred that the number of the moving members is identical to that of the fixing members.

Figure 22:
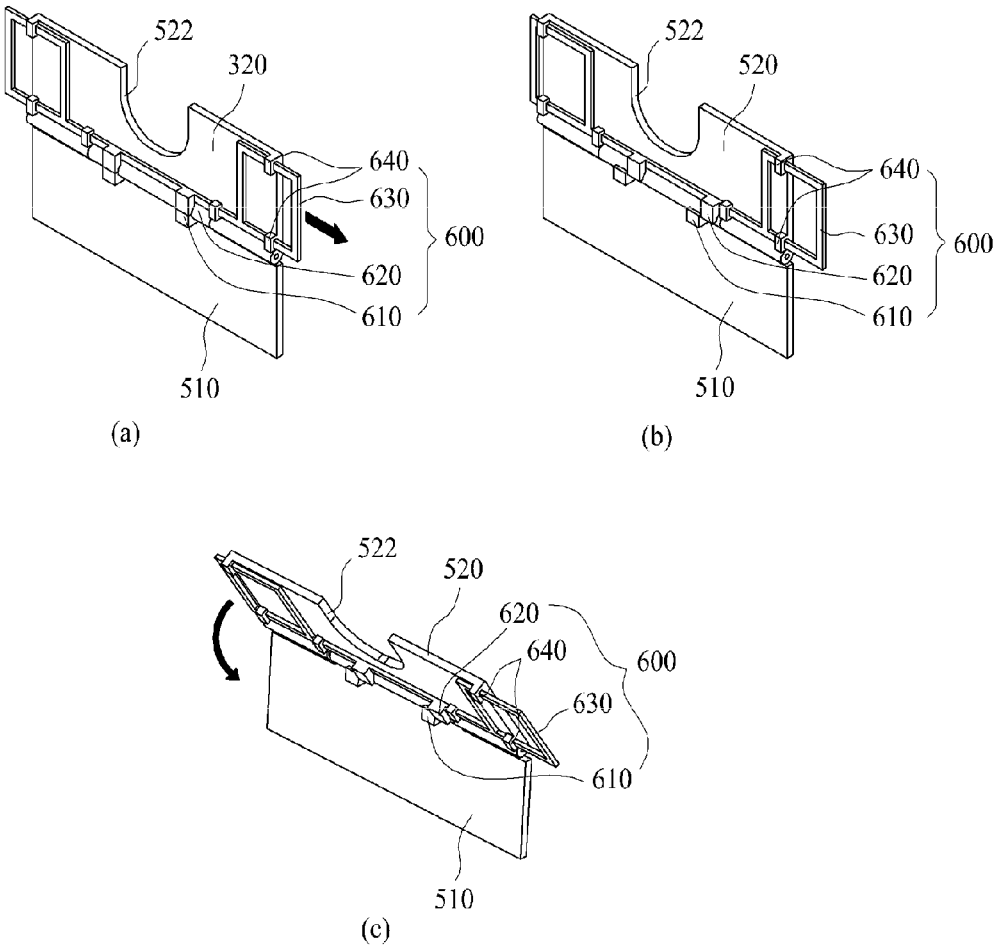
FIG. 22 is a diagram illustrating the operation of the headrest enabled by the tilting operation part shown in FIG. 19.

Referring to FIG. 22, the tilting operation part 600 and the process of the tilting the headrest 500 by the tilting operation part 600 will be described as follows.

FIG. 22 is a diagram illustrating the operation of the headrest enabled by the tilting operation part of FIG. 21.

As shown in the drawing, FIG. 22 (*a*) shows the headrest 500 in a state where the tilting operation part 600 is not operated by the user. At this time, the pair of the fixing members and the corresponding moving members 620 are in contact with each other. Even when the force is applied in a gravity direction, the auxiliary supporting member 520 is not tilted. The fixing members 610 and the moving members 620 support each other. In this state, the neck supporting member 510 and the auxiliary supporting member 520 are positioned in parallel, with supporting a back of the patient's neck.

When the user slides the operation frame 630 toward a right direction of the auxiliary supporting member 520 by applying an external force, the moving member 620 coupled to the operation frame 630 is moved in a right direction. In this instance, when the moving member 620 is moved in the right direction, the contact with the fixing member 610 is not maintained and the moving member 620 and the fixing member 610 cannot support each other.

As shown in FIG. 22 (*c*), the neck supporting member 510 and the auxiliary supporting member 520 are tilted by the gravity or the external force applied by the user. At this time, once they are tilted at a predetermined angle or more by the moving member 620 and the fixing member 610, the neck supporting member 510 and the auxiliary supporting member 520 are fixed, with no more tilting. When the tilting is generated at the predetermined angle or more, the moving member 620 contacts with a lower surface of the neck supporting member to support the neck supporting member and the fixing member 610 contacts with a lower surface of the auxiliary supporting member 520 to support the auxiliary supporting member 520.

The user may selectively adjust the tilting of the headrest 500 having the structure mentioned above by applying an external force to the tilting operation part 600.

In this embodiment, the operation frame 630 can slidably move along a horizontal direction of the auxiliary supporting member 520. However, the present invention is not limited thereto and various variations and modifications are possible in the component parts and/or arrangements of the subject combination arrangement within the scope of the disclosure, the drawings and the appended claims.

Figure 23:
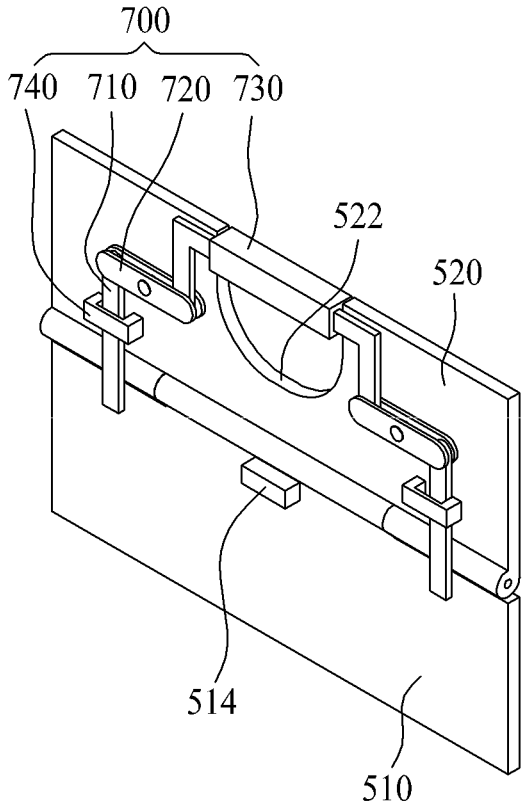
FIG. 23 is a perspective view illustrating a variation of the structure of the tilting operation part shown in FIG. 20.

Referring to FIG. 23, a variation of the tilting operation part according to this embodiment will be described as follows.

FIG. 23 is a perspective view illustrating a varied structure of the tilting operation part shown in FIG. 20.

As shown in FIG. 23, a tilting operation part 700 includes a moving link 710, an auxiliary link 720 and a control handle 730.

The moving link 710 is provided in a lower surface of the auxiliary supporting member 520 in a longitudinal direction. An inner end of the moving link 710 is able to slidably move to a lower surface of the neck supporting member 510 by the external force.

The moving link 710 may move along a supporting guide 740 provided in the coupling portion between the auxiliary supporting member 520 and the neck supporting member 510 in a longitudinal direction by the external force.

The auxiliary link 720 is rotatably coupled to a lower surface of the auxiliary supporting member 520, with maintaining a parallel state. A side of the auxiliary link 720 is rotatably coupled to the moving link 710 and the other side thereof is rotatably coupled to the control handle 730.

The auxiliary link 720 is rotated on a middle portion by the external force transmitted via the control handle 730. The moving link 710 can slide along the supporting guide 740 in a longitudinal direction of the auxiliary supporting member 520.

The control handle 730 is positioned under the opening 522 and it is rotatably coupled to the other side of the auxiliary link 720. The control handle 730 is moved in the longitudinal direction of the auxiliary supporting part by the external force applied by the user and it rotates the auxiliary link 720.

As shown in FIG. 23, the pair of the moving links 710 and the pair of the auxiliary links 720 may be provided in right and left portions with respect to the auxiliary supporting member 520, respectively. Both sides of the control handle 730 are rotatably coupled to the auxiliary link 720.

In this embodiment, the pair of the moving links 710 and the pair of the auxiliary links 720 may be provided and the present invention is not limited thereto. That is selected to make this embodiment understood more clearly. Any structures capable of operating the tilting of the neck supporting member 510 and the auxiliary supporting member 520 may be applicable.

Meanwhile, a restricting member 514 is provided in an outer lower end of the neck supporting member 510 to restrict the tilting of the headrest 500 at a predetermined angle or more.

A plurality of restricting members 514 may be provided. In this embodiment, the restricting member 514 is formed in an outer end of the neck supporting member 510. Also, the restricting member 514 may be provided at least one or both of the neck supporting member 510 and the auxiliary supporting member 520.

When the headrest 500 is tilted, the restricting member 514 contacts with a lower surface of an inner end of the auxiliary supporting member 520 to support the auxiliary supporting member 520. A critical value of the tilted angle of the headrest 500 may be adjusted by varying the shape of the restricting member 514.

The tilting operation part 700 having the structure mentioned above may enable the user to operate the control handle 730 to operate whether to tilt the headrest 500.

Figure 24:
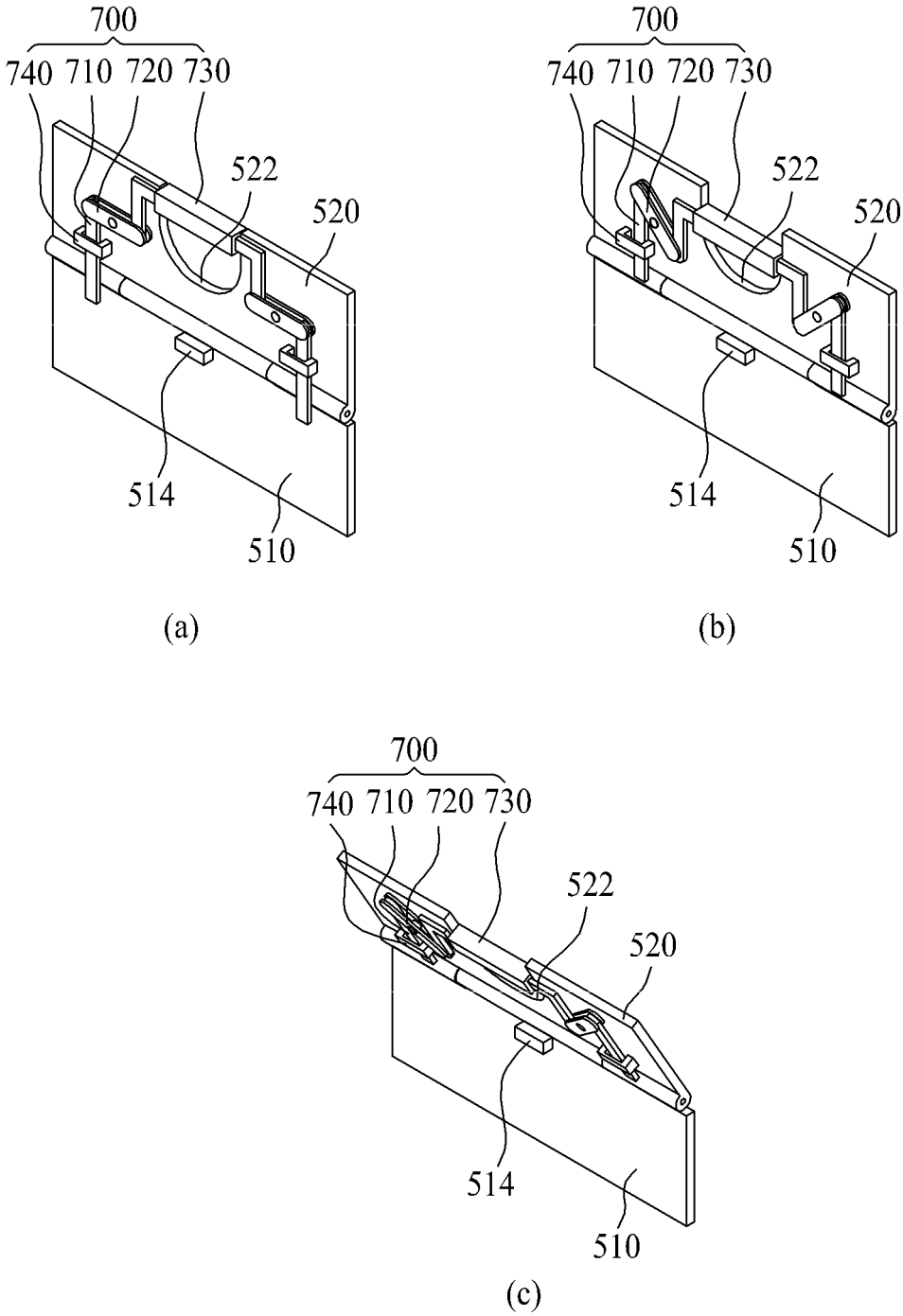
FIG. 24 is a diagram illustrating the operation of the headrest enabled by the tilting operation part shown in FIG. 23.

Referring to FIG. 24, the process of operating the tilting the headrest 500, using the varied example of the tilting operation part 700 will be described as follows.

FIG. 24 is a diagram illustrating the operation of the headrest enabled by the tilting operation part of FIG. 23.

As shown in FIG. 24 (*a*), unless the user operates the tilting operation part 700 via the control handle 730, a predetermined portion of the moving link 710 is positioned in the lower surface of the neck supporting member 510 and the other portion thereof is positioned in the lower surface of the auxiliary supporting member 520. Accordingly, the neck supporting member 510 and the auxiliary supporting member 520 may be supported and fixed, without tilting.

As shown in FIG. 24 (*b*), when the user applies an external force to the control handle 730 along the longitudinal direction of the auxiliary supporting member 520, the auxiliary link 720 is rotated by the control handle 730. When the pair of the auxiliary links 720 are rotated by the control handle 730 in a different direction, the pair of the moving links 710 connected to the auxiliary link 720 slidingly moves outwardly along the longitudinal direction of the auxiliary supporting member 520. At this time, the moving link 710 is supported by the supporting guide 740 not to be separated by the supporting guide 740 in a different direction.

When the moving link 710 is sliding outwardly in the longitudinal direction of the auxiliary supporting member 520, the moving link 710 is positioned only in the lower surface of the auxiliary supporting member 520, not in the lower surface of the neck supporting member 510.

Accordingly, as shown in FIG. 24 (*c*), the auxiliary supporting member 520 can be tilted and it can be tilted by the gravity or the external force applied by the user. The tilted angle of the auxiliary supporting member 520 may be adjusted by the restricting member 514.

Figure 25:
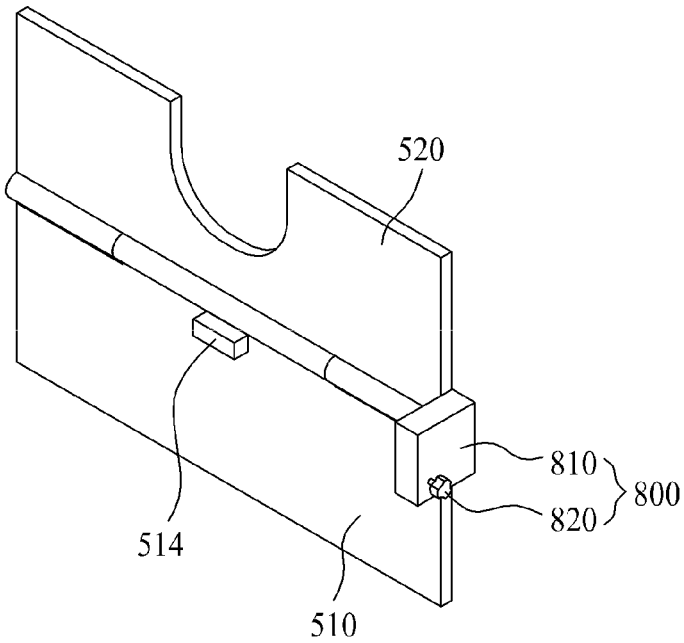
FIG. 25 is a perspective view illustrating another variation of the structure of the tilting operation part shown in FIG. 20.

Referring to FIG. 25, another variation of the tilting operation part according to this embodiment will be described as follows.

FIG. 25 is a perspective view illustrating the structure of this variation of the tilting operation part shown in FIG. 20.

As shown in FIG. 25, a tilting operation part 800 includes a gear box 810 and an operation handle 820.

The gear box 810 is provided with a plurality of gears engaging with each other and it is coupled to a lateral surface of the neck supporting member 510. A transmitting shaft providing outside the external force transmitted via the gears provided in the gear box 810 is coupled to the shaft on which the auxiliary supporting member 520 is tilted.

The gear box 810 is rotated by the plurality of the gears provided therein engaging with each other by the external force. Accordingly, the auxiliary supporting member 520 is tilted with respect to the shaft of the auxiliary supporting member 520.

The operation handle 820 is projected from a lateral surface of the gear box 810 and it is rotated by the user's operation, to provide the rotational force to the gear box 810.

The tilting operation part 800 provides the rotational force to the gear box 810 via the operation handle 820 and the auxiliary supporting member 520 is tilted by the rotational force provided to the gear box 810.

Figure 26:
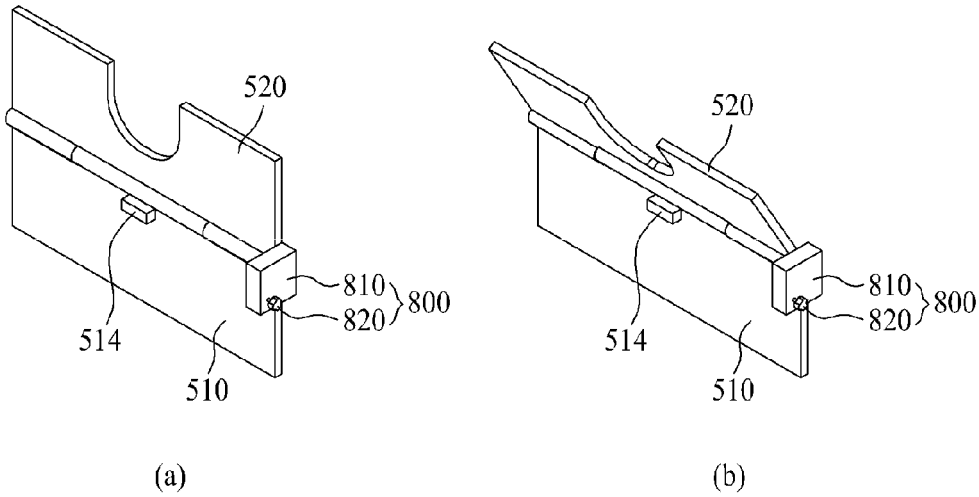
FIG. 26 is a diagram illustrating the operation of the headrest enabled by the tilting operation part shown in FIG. 25.

Referring to FIG. 26, the process of the tilting the headrest 500 according to the operation of the tilting operation part 800 will be described specifically as follows.

FIG. 26 is a diagram illustrating the operation of the headrest enabled by the tilting operation part.

First of all, referring to FIG. 26 (*a*), the bed 200 and the headrest 500 are positioned in parallel to support the patient's head seated on the upper surface of the headrest 500, without the external force applied to the tilting operation part 800 by the user.

As shown in FIG. 26 (*b*), the user operates the operation handle 820 to provide the rotational force to the gear box 810. The gear box 810 is rotated by the plurality of the gears engaging with each other by the provided rotational force. Accordingly, the plurality of the gears are rotated with respect to each other to rotate the auxiliary supporting member 520.

At this time, the tilting angle of the auxiliary supporting member 520 is determined according to the rotation number of the operation handle 820.

In this embodiment, the gear box 810 and the operation handle 820 are provided in the predetermined side of the headrest 500. However, the present invention is not limited thereto and that is selected to make the present invention understood clearly. It may be possible to provide the pair of the gear box 810 and the operation handle 820 in both sides of the headrest 500, respectively.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A senior-friendly shower carrier comprising:

a bed for accommodating a patient thereon;

a housing part comprising a second housing, a first housing coupled to a lower portion of the bed to elevate to an upper portion of the second housing, and a third housing that elevates to a lower portion of the second housing;

a first elevating module comprising a driving motor having a shaft provided therein, a fixing part rotated on a different shaft from the shaft, a power transmitting part for transmitting a rotational force of the shaft to the fixing part, and a moving part for elevating the first housing upwardly and moving along the rotation of the fixing part upwardly and downwardly, the first elevating module being positioned in the second housing; and a second elevating module comprising a driving motor having a shaft provided therein, a fixing part rotated on a different shaft from the shaft, a power transmitting part for transmitting a rotational force of the shaft to the fixing part, and a moving part for elevating the third housing downwardly and moving along the rotation of the fixing part upwardly and downwardly, the first elevating module being positioned in the second housing.

2. The senior-friendly shower carrier according to claim 1, wherein a length of the fixing part provided in each of the first and second elevating modules is larger than a length of the driving part provided in each of the first and second elevating modules, and each of the driving parts provided in the first and second elevating modules is provided in a predetermined lower portion of each of the fixing parts, and the driving motors of the first and second elevating modules are positioned in a space formed between the fixing parts and the moving parts are adapted to elevate in an opposite direction.

3. The senior-friendly shower carrier according to claim 1, wherein a lower surface of the first housing is open and a space is formed in the first housing to accommodate the second housing.

4. The senior-friendly shower carrier according to claim 1, wherein an upper surface of the third housing is open and a space is formed in the third housing to accommodate the second housing.

5. The senior-friendly shower carrier according to claim 1, wherein a lower surface of the first housing is open and a space is formed in the first housing to accommodate the second housing, and an upper surface of the third housing is open and a space is formed in the third housing to accommodate the first housing.

6. The senior-friendly shower carrier according to claim 1, wherein an upper surface of the third housing is open and a space is formed in the third housing to accommodate the second housing, and an upper surface of the first housing is open and a space is formed in the first housing to accommodate the third housing.

7. The senior-friendly shower carrier according to claim 1, wherein the bed is tilted at a predetermined angle to drain water smoothly.

8. The senior-friendly shower carrier according to claim 1, further comprising:

a headrest which supports a head of the patient lying on the bed, with a tilted angle or a projected degree that is variable according to the patient's physical characteristics; and a safety guide part provided in both sides of the bed to stand up selectively, to prevent the patient lying on the bed from falling out of the bed.

9. The senior-friendly shower carrier according to claim 8, further comprising:

a damping member provided between the headrest and the bed to prevent a drastic rotation of the headrest.

10. The senior-friendly shower carrier according to claim 8, wherein a driving unit is provided to adjust a tilted angle or projected degree of the headrest.

11. The senior-friendly shower carrier according to claim 8, wherein the driving unit comprises, a hinge part which rotatably couples the headrest to the bed;

an actuator which is selectively expandable;

an arm coupled to the actuator to be pushed or pulled according to an expansion of the actuator; and a bracket having an end rotatably coupled to a lower portion of the bed and an other end hingedly coupled to the hinge part of the headrest and spaced apart a predetermined distance from the hinge part, the other end being formed higher than the end to rotate with respect to the end, with an end of the arm hingedly coupled between the end and the other end and, the bracket being adapted to adjust a tilted angle or projected degree of the headrest while being rotated with respect to the end by the arm.

12. The senior-friendly shower carrier according to claim 8, wherein the safety guide part comprises, a first safety guide provided in a predetermined portion of the bed, the first safety guide being able to stand selectively; and a second safety guide provided in an other opposite portion of the bed, the second safety guide being able to stand selectively, and the first safety guide and the second safety guide configured to be driven independently from each other.

13. The senior-friendly shower carrier according to claim 12, wherein the first safety guide and the second safety guide are configured to lie or stand with rotating.

14. The senior-friendly shower carrier according to claim 13, wherein the safety guide part further comprises, a safety guide driving part for driving the first safety guide and the second safety guide to lie or stand independently.

15. The senior-friendly shower carrier according to claim 12, wherein the first safety guide and the second safety guide are configured selectively to stand beyond the bed or to lie below the bed and to slide vertically.

16. The senior-friendly shower carrier according to claim 15, wherein the safety guide part further comprises, a safety guide driving part for driving the first safety guide and the second safety guide to lie or stand independently.

17. The senior-friendly shower carrier according to claim 1, further comprising:

a headrest positioned in an upper portion of the bed, with the patient's head positioned thereon, the headrest having a side hingedly coupled to the bed to rotate with respect to the bed in an upward or downward direction; and a coupling unit comprising a first bed coupling part projected from a predetermined portion of the bed with a coupling hole formed in a predetermined portion thereof, a head coupling part projected from a side of the headrest with a first shaft formed therein to be inserted in the coupling hole, a second bed coupling part projected from a side of the bed with a second shaft partially formed therein, a special bearing coupled to the second shaft to enable the headrest to rotate only in an upward direction, a sprocket coupled to an outer surface of the special bearing, and an angle adjusting handle provided in a side of the headrest with a side engaging with the sprocket.

18. The senior-friendly shower carrier according to claim 17, wherein the angle adjusting handle has a side which can be pulled by a user's hand, and when the headrest rotates in the upward direction, the headrest engages with the sprocket to rotate together with the sprocket, and when the headrest rotates in the downward direction, the angle adjusting handle is pulled upwardly to release the engagement between the sprocket and the angle adjusting handle such that the headrest may be rotatable in the downward direction.

19. The senior-friendly shower carrier according to claim 18, wherein the angle adjusting handle comprises an elastic member which provides an elastic force toward the engaging portion with the sprocket.

20. The senior-friendly shower carrier according to claim 1, further comprising:

a headrest comprising a plurality of members rotatable coupled to an end of the bed, the plurality of the members which are able to be tilted by the user's operation independently.

21. The senior-friendly shower carrier according to claim 20, wherein the headrest comprises, a neck supporting member rotatably coupled to a predetermined portion of the bed to support the patient's neck; and an auxiliary supporting member positioned outer to the neck supporting member in a longitudinal direction with a side rotatably coupled to the neck supporting member.

22. The senior-friendly shower carrier according to claim 21, further comprising:

a tilting operation part provided in a center portion of the headrest to tilt the headrest.

23. The senior-friendly shower carrier according to claim 22, wherein the tilting operation part is provided in a coupling area between the neck supporting member and the auxiliary supporting member, to operate tilting of the neck supporting member and the auxiliary supporting member.

24. The senior-friendly shower carrier according to claim 23, wherein the tilting operation part comprises, a fixing member provided in a lower surface of an outer end of the neck supporting member in a longitudinal direction;

an operation frame movably coupled to a lower surface of the auxiliary supporting member in a horizontal direction; and a moving member provided in a center portion of the operation frame and being contactable with the fixing member correspondingly.

25. The senior-friendly shower carrier according to claim 23, wherein the tilting operation part comprises, a moving link provided in a lower surface of the auxiliary supporting member in a longitudinal direction with an inner end which is able to slide to a lower surface of the neck supporting member; and a control handle provided in an outer end of the auxiliary supporting member and being connected to the moving link to control the sliding.

26. The senior-friendly shower carrier according to claim 23, wherein the tilting operation part comprises, a gear box provided in the coupling area between the neck supporting member and the auxiliary supporting member and configured to be rotated by an external force to adjust tilting of the auxiliary supporting member, and an operation handle connected to the gear box and projected from a lateral surface of the gear box to provide a rotational force generated by the user.

27. The senior-friendly shower carrier according to claim 20, wherein the headrest comprises an opening formed in an outer end thereof along a longitudinal direction.

28. The senior-friendly shower carrier according to claim 1, further comprising:

a base frame coupled to a lower portion of the housing part to support the bed and spaced apart a predetermined distance from the ground, the base frame comprising a plurality of wheels provided in a side thereof to enable an movement of the bed; and a drive-assisting unit comprising a driving wheel in contact with a ground and a driving motor for providing a driving force to the driving wheel, the drive-assisting unit being selectively in contact with the ground by a user's operation.

29. The senior-friendly shower carrier according to claim 28, wherein the driving wheel is positioned between moving wheels to prevent an interference with a movement of the shower carrier.

30. The senior-friendly shower carrier according to claim 28, wherein the drive-assisting unit further comprises, a driving link coupled to at least one of the bed and the base frame with the driving wheel positioned in a lower end thereof to support the driving wheel, the driving link being adapted to move positions of the driving wheel and the motor.

31. The senior-friendly shower carrier according to claim 30, wherein the drive-assisting unit comprises, a lever provided in an end of the bed with a predetermined portion thoroughly fixed to a grip part to surround the grip part, and a wire having both ends connected to the driving link and the lever, respectively, to transmit an external force applied by a user to the driving link.

32. The senior-friendly shower carrier according to claim 30, wherein the driving link further comprises, an operation handle provided in an outer end thereof to operate driving of the operation motor by adjusting a rotational movement of the driving link.

33. The senior-friendly shower carrier according to claim 30, wherein the driving link is coupled to the driving wheel to elastically support the driving wheel when the driving wheel contacts the ground.

34. The senior-friendly shower carrier according to claim 30, wherein the drive-assisting unit further comprises an operation control part for determining whether to operate the driving wheel according to an operation of the driving link.

35. The senior-friendly shower carrier according to claim 34, wherein the operation control part comprises a proximity sensor for determining whether to operate the driving wheel by sensing a distance between the driving link and the bed.

36. The senior-friendly shower carrier according to claim 34, wherein the operation control part comprises a rotation sensing sensor for determining whether to drive the driving wheel based on a rotational state of the driving link.

37. The senior-friendly shower carrier according to claim 28, wherein the operation motor measures a rotation number of the moving wheel and adjusts a rotation number of the driving wheel commensurate with the measured rotation number.

* * * * *